US010641043B2

(12) United States Patent
Sevits et al.

(10) Patent No.: US 10,641,043 B2
(45) Date of Patent: May 5, 2020

(54) POSITIONABLE CARRIAGE ASSEMBLY

(71) Applicant: VERMEER MANUFACTURING COMPANY, Pella, IA (US)

(72) Inventors: Jacob Sevits, Pella, IA (US); Peter C. Rozendaal, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 238 days.

(21) Appl. No.: 15/539,034

(22) PCT Filed: Dec. 22, 2015

(86) PCT No.: PCT/US2015/067402

§ 371 (c)(1),
(2) Date: Jun. 22, 2017

(87) PCT Pub. No.: WO2016/106327

PCT Pub. Date: Jun. 30, 2016

(65) Prior Publication Data

US 2017/0370149 A1 Dec. 28, 2017

Related U.S. Application Data

(60) Provisional application No. 62/095,395, filed on Dec. 22, 2014.

(51) Int. Cl.
*E21B 19/14* (2006.01)
*E21B 7/02* (2006.01)
(Continued)

(52) U.S. Cl.
CPC ..... *E21B 7/022* (2013.01); *E02F 3/3681* (2013.01); *E02F 5/16* (2013.01); *E21B 7/02* (2013.01);
(Continued)

(58) Field of Classification Search
CPC ..... E21B 19/14; E21B 19/155; E21B 19/15; E21B 7/022
See application file for complete search history.

(56) References Cited

U.S. PATENT DOCUMENTS 795,190 A 7/1905 Bohannan
1,145,157 A 7/1915 Mann
(Continued)

FOREIGN PATENT DOCUMENTS

CH 569 889 A5 11/1975
CN 202318629 U 7/2012
(Continued)

OTHER PUBLICATIONS

International Search Report and Written Opinion of the International Searching Authority for corresponding International Patent Application No. PCT/US2015/067402 dated Apr. 16, 2016, 19 pages.
(Continued)

*Primary Examiner* — Catherine Loikith
(74) *Attorney, Agent, or Firm* — Michael Best & Friedrich LLP

(57) ABSTRACT

A positionable carriage assembly including an actuation device, such as one or more linear hydraulic cylinders, that is linked to a linear drive element. The linear drive element can include a first and second gear racks. The positionable carriage assembly may also include a first carriage member having a third gear rack and a second carriage member having a fourth gear rack. A first gear structure may be provided that operably intermeshes with the first and third racks while a second gear structure may be provided that operably intermeshes with the second and fourth racks. In operation the actuation device imparts a linear movement in a first direction onto the linear drive element which in turn imparts a synchronized linear movement in a second direc-
(Continued)

tion orthogonal the first direction onto the carriage members via the intermediate first and second gear structures.

16 Claims, 19 Drawing Sheets

(51) Int. Cl.

| | |
|---|---|
| ***E02F 5/16*** | (2006.01) |
| ***E21B 19/15*** | (2006.01) |
| ***E02F 3/36*** | (2006.01) |
| *E21B 7/04* | (2006.01) |
| *E21B 15/04* | (2006.01) |
| *E21B 19/20* | (2006.01) |

(52) U.S. Cl.
CPC ..... *E21B 19/15* (2013.01); *E21B 19/155* (2013.01); *E21B 7/046* (2013.01); *E21B 15/045* (2013.01); *E21B 19/20* (2013.01)

(56) References Cited

U.S. PATENT DOCUMENTS

| | | | | |
|---|---|---|---|---|
| 2,337,330 | A | 12/1943 | Julin | |
| 3,349,927 | A * | 10/1967 | Blatt | B21D 43/18 24/463 |
| 3,398,595 | A | 8/1968 | Clutter | |
| 3,665,771 | A | 5/1972 | Blatt | |
| 3,765,251 | A | 10/1973 | Whitenack | |
| 3,835,938 | A | 9/1974 | Moody et al. | |
| 3,848,759 | A | 11/1974 | Goodacre | |
| 4,099,787 | A | 7/1978 | Askew | |
| 4,270,404 | A | 6/1981 | Murakoshi et al. | |
| 4,704,913 | A | 11/1987 | Zimmer | |
| 4,757,725 | A | 7/1988 | Beugin | |
| 4,941,396 | A | 7/1990 | McCabe | |
| 5,113,224 | A | 5/1992 | Tsuda | |
| 5,154,469 | A | 10/1992 | Morrow | |
| 5,267,478 | A | 12/1993 | Stridsberg | |
| 5,556,253 | A | 9/1996 | Rozendaal et al. | |
| 5,607,280 | A | 3/1997 | Rozendaal | |
| 5,791,822 | A | 8/1998 | Edmondson et al. | |
| 5,836,205 | A | 11/1998 | Meyer | |
| 5,902,001 | A | 5/1999 | Schneider | |
| 6,085,852 | A | 7/2000 | Sparks et al. | |
| 6,145,252 | A | 11/2000 | Fenelon | |
| 6,179,065 | B1 | 1/2001 | Payne et al. | |
| 6,283,422 | B1 | 9/2001 | Stoelinga | |
| 6,283,702 | B1 | 9/2001 | Devlugt et al. | |
| 6,314,680 | B1 | 11/2001 | Buckwalter et al. | |
| 6,360,830 | B1 | 3/2002 | Price | |
| 6,374,928 | B1 | 4/2002 | Teller et al. | |
| 6,408,954 | B1 | 6/2002 | Price et al. | |
| 6,474,931 | B1 | 11/2002 | Austin et al. | |
| 6,474,932 | B1 | 11/2002 | Rush | |
| 6,497,296 | B1 | 12/2002 | McGriff et al. | |
| 6,543,551 | B1 | 4/2003 | Sparks et al. | |
| 6,543,555 | B2 | 4/2003 | Casagrande | |
| 6,550,547 | B1 | 4/2003 | Payne et al. | |
| 6,619,714 | B2 | 9/2003 | Schneider et al. | |
| 6,820,369 | B2 | 11/2004 | Fenelon | |
| 6,994,040 | B2 | 2/2006 | Rotter et al. | |
| 7,004,462 | B2 | 2/2006 | Bryer | |
| 7,011,166 | B2 | 3/2006 | Koch et al. | |
| 7,018,164 | B2 | 3/2006 | Anthis et al. | |
| 7,140,151 | B2 | 11/2006 | Spaziani et al. | |
| 7,229,123 | B2 | 6/2007 | Kunz | |
| 7,392,628 | B2 | 7/2008 | Logan et al. | |
| 7,467,670 | B2 * | 12/2008 | Hartke | E21B 19/14 175/52 |
| 7,536,927 | B2 | 5/2009 | Fleytman et al. | |
| 7,544,036 | B1 | 6/2009 | Randall et al. | |
| 7,669,380 | B2 | 3/2010 | Logan et al. | |
| 8,104,368 | B2 | 1/2012 | Aaron | |
| 8,157,495 | B1 | 4/2012 | Randall | |
| 8,522,636 | B2 | 9/2013 | Uchida | |
| 8,573,666 | B2 | 11/2013 | Schwindaman et al. | |
| 8,727,666 | B2 | 5/2014 | Farley et al. | |
| 8,757,017 | B2 | 6/2014 | Bauer et al. | |
| 2004/0007388 | A1 | 1/2004 | Mills et al. | |
| 2006/0060382 | A1 | 3/2006 | Sewell et al. | |
| 2014/0238745 | A1 | 8/2014 | Dahmes et al. | |

FOREIGN PATENT DOCUMENTS

| | | | |
|---|---|---|---|
| CN | 203680366 | U | 7/2014 |
| CN | 203696562 | U | 7/2014 |
| EP | 0 182 500 | A1 | 5/1986 |
| EP | 0 984 132 | A2 | 3/2000 |
| EP | 1 278 972 | B1 | 4/2004 |
| EP | 1 232 340 | B1 | 9/2004 |
| GB | 753 202 | A | 7/1956 |
| GB | 2 472 310 | A | 2/2011 |
| JP | S60-166020 | A | 8/1985 |
| JP | H08-417 | A | 1/1996 |
| WO | 00/73176 | A2 | 12/2000 |
| WO | 2006/024183 | A1 | 3/2006 |
| WO | 2012/075289 | A1 | 6/2012 |

OTHER PUBLICATIONS

Loaders, MPNB Loaders, Drill-Loader, Kopeysk Machine-Building Plants, 2002-2017, 2 pages, http://www.kopemash.ru/en/products/67/348.html.

Extended European Search Report for corresponding European Patent Application No. 15874309.6 dated Jul. 31, 2018, 9 pages.

* cited by examiner

POSITIONABLE CARRIAGE ASSEMBLY

This application is a National Stage Application of PCT/US2015/067402, filed Dec. 22, 2015, which claims the benefit of U.S. Provisional Patent Application No. 62/095,395, filed Dec. 22, 2014, the disclosures of which is are hereby incorporated by reference herein in their entireties. To the extent appropriate, a claim of priority is made to each of the above disclosed applications.

TECHNICAL FIELD

The present invention relates generally to positionable carriage assemblies. Positionable carriage assemblies can be utilized in a wide variety of implementations, for example, as part of a slide-out camper assembly or as part of a directional drilling machine to move a pair of rod loader arms or a drill rod magazine carriage.

BACKGROUND

Positionable carriage assemblies for supporting and positioning a load are known. Some positionable carriage assemblies include a rack and pinion drive system wherein one or more driven carriage arms include a rack driven by a hydraulic or electric motor having a pinion gear. Where precise positioning of such systems is desired, these types of carriage assemblies can have limitations. For example, due to the construction of hydraulic motors, the exact position of the pinion gear cannot be reliably ascertained with a high degree of accuracy. Variations in hydraulic fluid temperature can also affect accuracy. These types of limitations can result in hunting of the control system. Carriage assemblies of this type can also require a high number of parts, resulting in increased costs and decreased reliability. In addition, some implementations can also result in excessive wear on the motor(s), and in particular the bearings. Furthermore, many existing systems require significant space for the mounting of the motor(s) and other related components. Accordingly, a need exists for a durable and compact positionable carriage assembly with few moving parts that can be accurately and reliably positioned.

One non-limiting application of a positionable carriage assembly is in a directional drilling machine application. Directional drilling machines are used to drill holes along a generally horizontal path beneath the ground. After a hole is drilled, a length of product (e.g., cable, pipe or the like) can be passed through the hole. Such directional drilling machines eliminate the need for digging a long trench to lay a length of product underground.

A typical directional drilling machine includes an elongated track that can be aligned at an inclined orientation relative to the ground. A drive head is mounted on the track so as to be moveable along the length of the track. The drive head includes a drive member that is rotated about a drive axis that is generally parallel to the track. The drive member is adapted for connection to a length of pipe. For example, the drive member can include a threaded end having either female or male threads.

To enhance drilling productivity, it is important to maximize the efficiency in which pipes can be loaded into and unloaded from the magazine of a directional drilling machine. Until fairly recently, pipes were manually carried between the magazine and the drive head of a drilling machine, and were also manually loaded into and unloaded from the magazine. Recent developments have improved pipe loading and unloading efficiencies through automation.

For example, U.S. Pat. No. 5,556,253 to Rozendaal et al. (the '253 patent), and U.S. Pat. No. 5,607,280 (the '280 patent) to Rozendaal, disclose improved pipe loading/unloading devices. The '253 and '280 patents disclose devices that effectively use gravity to automatically unload pipes from a magazine. The '253 and '280 patents also disclose devices each having pipe transfer members that automatically move pipes between a magazine and a drive head. The advances provided by the devices disclosed in the '253 and '280 patents have assisted in significantly improving a drill operator's ability to enhance drilling productivity. PCT Publication WO 2012/075289 (the '289 publication) to Novelo also discloses a system including shuttles for moving pipes between a drill rod magazine and the drive head. Each of U.S. Pat. No. 5,556,253; 5,607,280; and PCT WO 2012/075289 is hereby incorporated by reference in its entirety.

SUMMARY

One aspect of the present disclosure relates to an actuation device that generally includes a fluid cylinder, a drive rack structure, a driven rack, and a gear structure. The fluid cylinder device can include a cylinder and a piston. The drive rack structure can be reciprocated along a first orientation by the fluid cylinder device. The driven rack can be coupled to a driven component that reciprocates along a second orientation relative to the first orientation (e.g., angled, collinear, or parallel). In one aspect, the gear structure transfers torque from the drive rack structure to the driven rack such that when the drive rack structure is moved along the first orientation by the fluid cylinder device the driven rack and the driven component are moved by the gear structure along the second orientation.

Overall, such an actuation device may, in one broad aspect, facilitate a synchronized movement of two spaced-apart points. Those spaced-apart points may be, for example, respective locations on two separate components or spaced-apart locations on a single component.

In one example, the actuation device may be utilized as part of a horizontal directional drill system. However, it is to be understood that it could employed with similar benefits in other systems involving movement of an elongate structure that also has some consequential width and/or depth, such as, by way of example only, in the case of camper slide-outs. These types of uses are thus considered to be within the scope of the present disclosure.

In an example associated with the use of the actuation device as part of a horizontal directional drill system, a pair of rod loader arms may be the components being driven by the actuation device. In particular, a first point of the two points to be synchronously moved may be a part of the first rod loader arm, and the second point may be a part of the second rod loader arm. In this example, a goal is to move a rod, that is supported by the rod loader arms, so that the rod moves so that a first point, at one end of the rod, as supported by the first rod loader arm, moves in a synchronized manner with a second point, at the opposite end of the rod, as supported by the second rod loader arm.

In an example associated with the use of the actuation device as part of a horizontal directional drill system, a rod box may be the component to be moved by the actuation device. In such an instance, a first point may be at one general end of the rod box, and a second point may be the opposing second general end thereof.

Another aspect of the present disclosure relates to a positionable carriage assembly. In one example, the positionable carriage assembly can include a hydraulic cylinder and a linear drive element drivably linked to the hydraulic cylinder. In one aspect, the linear drive element can include at least a first rack portion and a second rack portion. The first rack portion can be spaced from the second rack portion. In one example, a first gear structure can be provided that has a first pinion gear and an interconnected second pinion gear, wherein the first pinion gear operably intermeshes with the first rack portion. A second gear structure can also be provided that has a second gear structure having a third pinion gear and a fourth interconnected pinion gear, wherein the third pinion gear operably intermeshes with the second rack portion. A third rack element operably intermeshing with the second pinion gear and a fourth rack element operably intermeshing with the fourth pinion gear can also be provided. In one example, the at least one carriage element is mounted to at least one of the third rack element and the fourth rack element.

In one example, a horizontal directional drilling apparatus is provided that utilizes the aforementioned positionable carriage assembly. In such a configuration, the first carriage element can be configured as a first rod loader arm and the second carriage element can be defined as a second rod loader arm.

In one example, a drilling machine is provided that includes a boring mechanism and a drill rod delivery system. In one aspect, the boring mechanism can be configured to deliver at least one elongate drill rod into the ground. In one aspect, the drill rod delivery system can be configured to provide the at least one given elongate drill rod to the boring mechanism. In one example, the drill rod delivery includes a rod carrying mechanism and a drive mechanism configured to move the rod carrying mechanism. The rod carrying mechanism can include at least a pair of rod support members that are spaced apart from one another so as to accommodate at least one given drill rod therebetween. In one aspect, the pair of rod support members are mechanically linked to the drive mechanism in such a manner so that the pair of rod support members are configured to move synchronously with one another.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
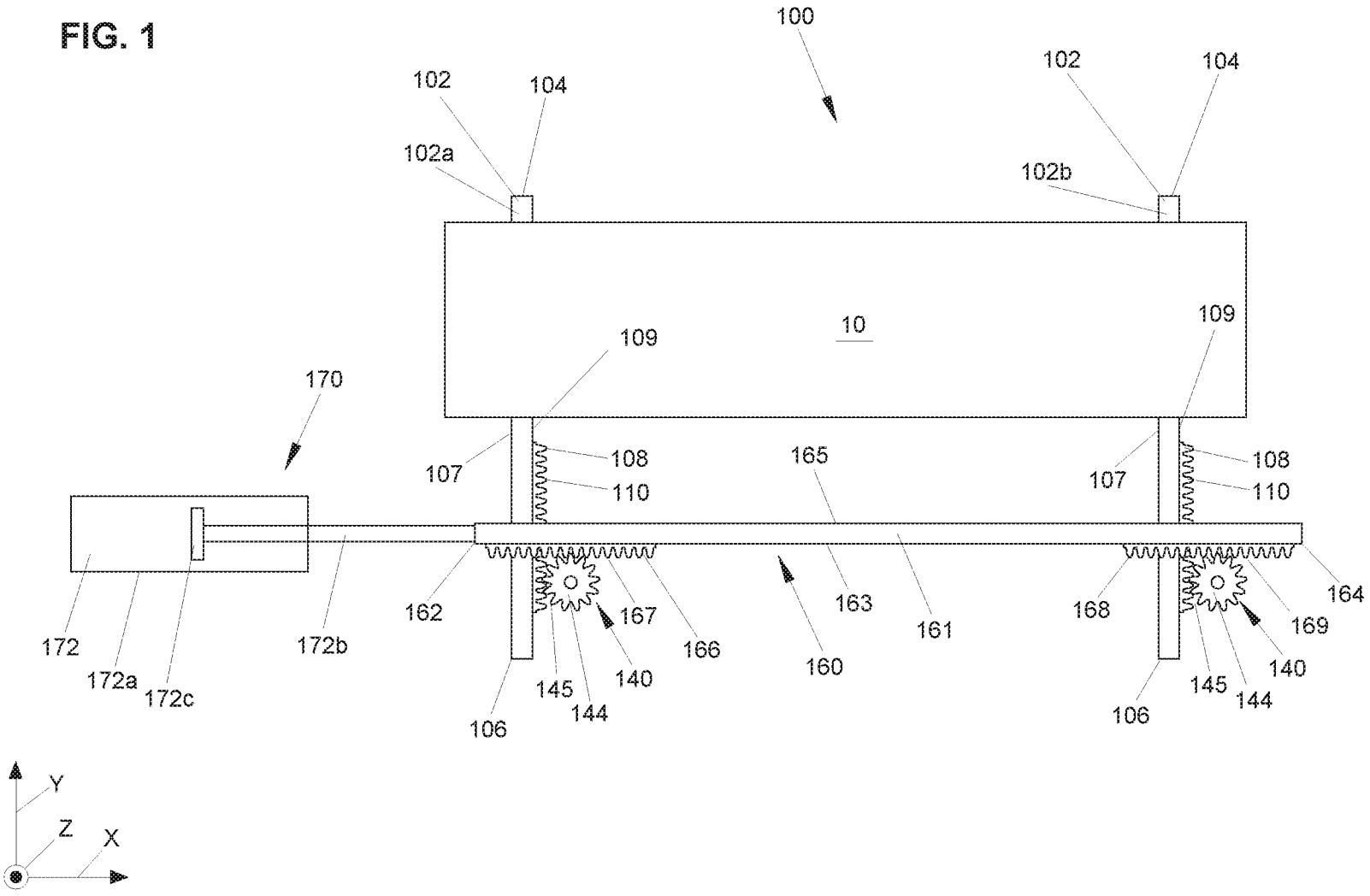
FIG. 1 is a schematic top view of a first embodiment of a positionable carriage assembly having features of the disclosed invention.

Referring to FIG. 1, an example of a positionable carriage assembly 100 is presented. As shown, the positionable carriage assembly 100 can include a pair of carriage arms 102 for carrying a load 10. Load 10 can be any type of load for which support by carriage arms 102 is desired, for example, one or more elongate structures, one or more tubes, a carriage assembly, a portion of a structure, and/or a portion of a machine. The load 10 may be permanently attached to the carriage arms 102 or may be simply supported by, but not attached to the carriage arms 102. As mentioned previously, the load may be a portion of a camper, such as a slide-out portion of a camper or may be one or more pipes or a carrier for such pipes, such as used in a directional drilling machine.

The positionable carriage assembly 100 is also shown as including a pair of gear structures 140, a linear drive element 160, and an actuation system 170. As discussed in more detail later, the positionable carriage assembly 10 is configured such that the actuation system 170 is connected to the linear drive element 160 and such that each gear structure 140 is engaged with a carriage arm 102 and with the linear drive element 160. In operation, the actuation system 170 drives the linear drive element 160 in a first direction to impart a rotational movement onto each of the gear structures 140, which, in turn, imparts a movement onto each of the carriage arms 102 in a second direction.

In one aspect, the carriage arms 102 of the positionable carriage assembly 100 are shown as including a first carriage arm 102*a* and a second carriage arm 102*b*. However, it should be noted that a single carriage arm 102 may be provided or more than two carriage arms 102 may be provided, such as three, four, or five carriage arms 102. As presented in the drawings, the carriage arms 102*a* and 102*b* can have a substantially identical configuration. Accordingly, each individual carriage arm 102*a*, 102*b*, may be referred to as carriage arm 102 with the description being applicable to both carriage arms 102*a*, 102*b*. It is noted that the configuration of the carriage arms 102 need not be identical to the other. For example, the carriage arms 102 may be mirror reproductions of each other.

Figure 2:
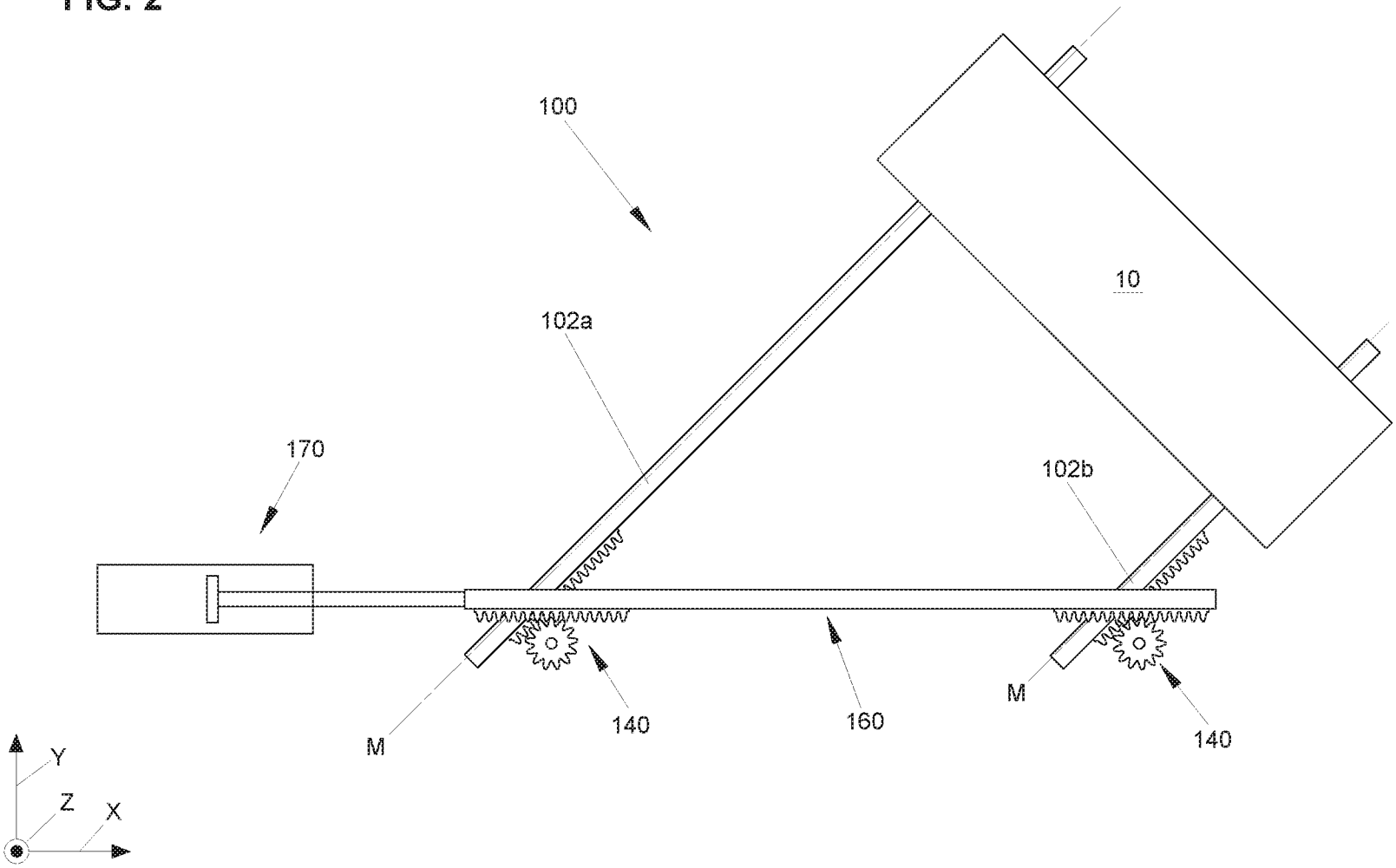
FIG. 2 is a schematic top view of a second embodiment of a positionable carriage assembly having features of the disclosed invention.
Figure 3:
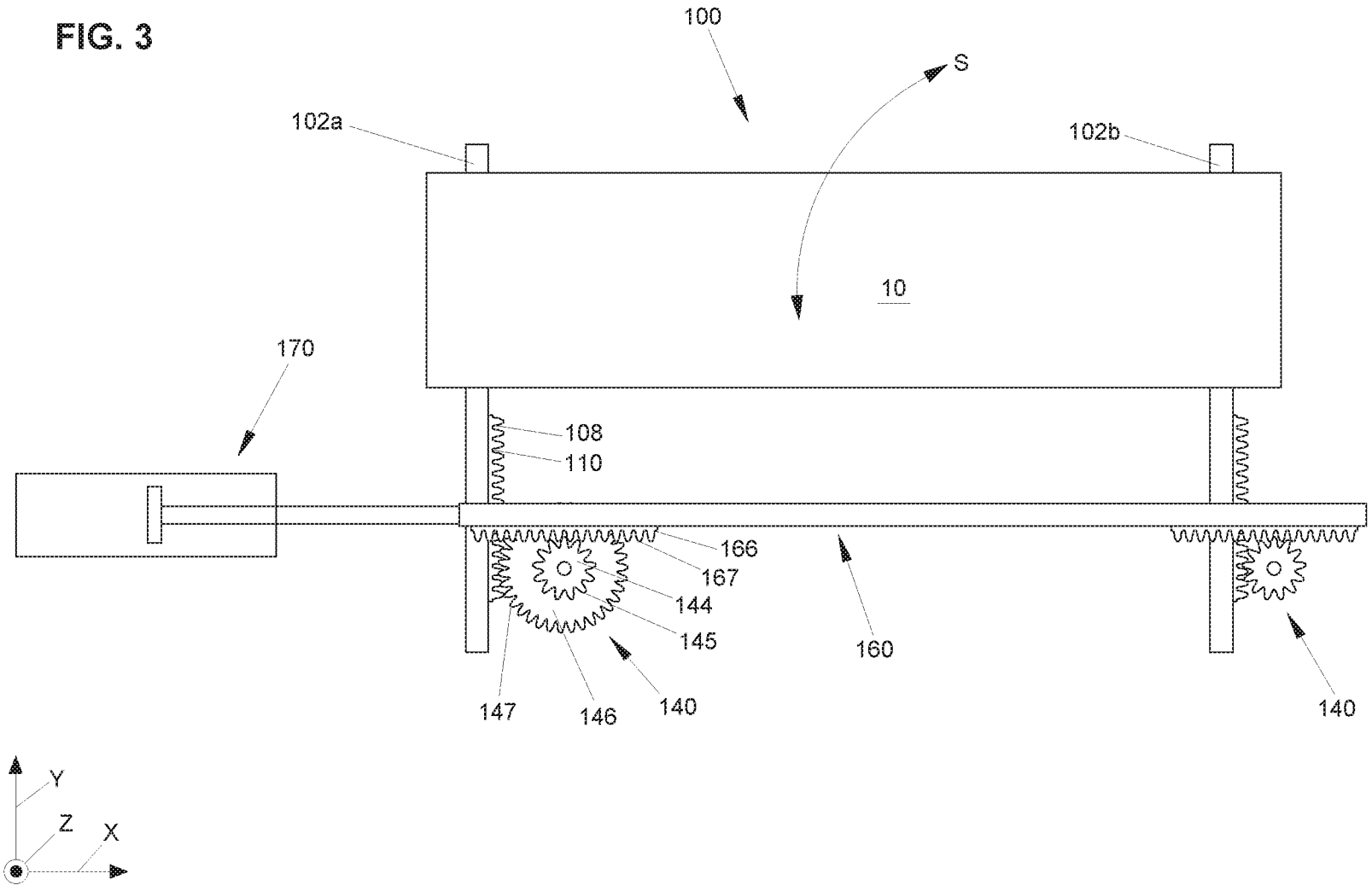
FIG. 3 is a schematic top view of a third embodiment of a positionable carriage assembly having features of the disclosed invention.

As shown, each carriage arm 102 is configured with a first end 104, a second end 106, a first side 107, and a second side 109. Each carriage arm 102 is also shown as being provided with a gear rack 108 on the carriage arm second side 109. In one aspect, the gear rack 108 is provided with a plurality of teeth 110 extending along the length of the rack 108. In the exemplary embodiment shown in FIG. 1, each carriage aim 102 is movable between an extended position and a retracted position in a direction parallel to an axis Y. As shown in FIGS. 2-3 and discussed later, it is noted that the carriage arms 102 may be configured to translate in a direction other than one parallel to the Y axis and may also be movable at different rates such that the combined movement of the arms 102 is non-linear.

In one aspect, the linear drive element 160 is a configured as a rigid elongate member or bar 161 having first and second sides 163, 165 extending between first and second ends 162, 164. In one aspect, the linear drive element 160 reciprocally translates in a direction parallel to the length of the linear drive element 160 and parallel to an axis X. As shown, the axis X and the axis Y are orthogonal to one another. As shown, a gear rack 166 is provided on the first side 163 of the linear drive element 160 proximate the first end 162, while a gear rack 168 is provided on the first side 163 of the linear drive element 160 proximate the second end 164. Accordingly, the elongate member or bar 161 interconnects the gear racks 166, 168 such that they are co-linearly arranged along a common longitudinal axis. As with gear racks 108, each gear rack 166, 168 is respectively provided with a plurality of teeth 167, 169 extending along the length of the gear rack 166, 168.

As shown, each of the gear structures 140 includes a first pinion gear 144 having a plurality of teeth 145. As configured, each of the pinion gears 144 rotates about an axis parallel to an axis Z, which is shown as being orthogonal to axes X and Y. For the gear structure 140 associated with the first carriage member 102*a*, the teeth 145 of the first pinion gear 144 operably intermesh with the teeth 167 of the gear rack 166. For the gear structure 140 associated with the second carriage member 102*b*, the teeth 145 of the first pinion gear 144 operably intermesh with the teeth 169 of the gear rack 168. The teeth 145 of each pinion gear 144 are also shown as operably intermeshing with the teeth 110 of the rack 108 of the respective carriage arm 102. In one aspect, the gear structures 140 and gear racks 108, 166, 168 may be collectively referred to as a gear drive assembly. Each of the gear structures 140 may be configured to have multiple interconnected pinion gears and/or differently sized pinion gears for establishing any desired gear ratio between the linear drive element 160 and the carriage arms 102*a*, 102*b*. Where a single pinion gear 144 is utilized to interconnect the carriage arm 102 with the drive element 160, a 1:1 gear ratio will exist.

As mentioned previously, the positionable carriage assembly 100 can also be provided with an actuation system 170 to reciprocally operate the linear drive element 160. The actuation system 170 may also be referred to as a drive mechanism 170. Still referring to FIG. 1, the actuation system 170 can include an actuator 172 that is configured as a linear hydraulic actuator, with the actuator 172 having a cylinder 172*a*, a rod 172*b*, and a piston 172*c* connected to the respective rod 172*b*. The rod 172*b* extends into the respective cylinder 172*a* and is connected with the linear drive element 160. Other numbers and types of actuators may be used, although some types of actuators may yield reduced positional accuracy.

As the gear racks 166 and 168 are each connected to the rigid linear drive element 160, any translation of the linear drive element 160 towards the first or second end 162, 164 will result in the synchronized movement of both of the carriage arms 102*a*, 102*b*. In operation, movement of the linear drive element 160 towards the first or second end 162, 164 and parallel to the axis X imparts a rotational movement onto each of the gear structures 140 about an axis parallel to axis Z. The rotation of the gear structures 140 in turn imparts a linear movement onto each of the carriage arms 102*a*, 102*b* in a direction that is parallel to the axis Y. Resultantly, a linear translation of the linear drive element 160 along a first axis imparts a corresponding linear translation of both carriage arms 102*a*, 102*b* along a second axis orthogonal to the first axis. In the exemplary embodiment shown, the gear drive assembly is configured such that translation of the linear drive element 160 in a direction towards the first end 162 results in the carriage arms 102 being moved towards the extended orientation, while translation of the linear drive element 160 in a direction towards the second end 164 results in the carriage arms 102 being synchronously moved towards the retracted orientation. However, it should be noted that the gear drive assembly could be configured to produce the opposite action without departing from the concepts presented herein.

Referring to FIG. 2, a second embodiment of a positionable carriage assembly 100 is shown. The second embodiment is similar to the first embodiment in many respects. Therefore, the description for the first embodiment is applicable to the second embodiment. The second embodiment differs from the first embodiment only in the respect that the carriage arms 102 are aligned and movable along an axis that is not parallel to the Y axis. Rather, the carriage arms 102 are movable in a direction that is parallel to an axis M which is at an oblique angle to axes X and Y. Accordingly, a translation of the linear drive element 60 in a first direction imparts a movement onto the arms 102 that is at an oblique angle to the first direction.

Referring to FIG. 3, a third embodiment of a positionable carriage assembly 100 is shown. The third embodiment is similar to the first embodiment in many respects. Therefore, the description for the first embodiment is applicable to the third embodiment. The third embodiment differs from the first embodiment in that the gear structure 140 associated with the first carriage arm 102*a* is configured with two differently sized rigidly interconnected pinion gears 144, 146, wherein the teeth 145 of the pinion gear 144 engage with the teeth 167 of the rack 166 and wherein the teeth 147 of the pinion gear 146 engage with the teeth 110 of the rack 108. As shown, the pinion gear 146 is about twice the size of the pinion gear 144 such that an increment movement of the linear drive element 160 results in twice the increment movement at the carriage arm 102*a* for an effective 2:1 gear ratio. As such, the first carriage arm 102*a* will extend and retract at twice the rate of that of the second carriage arm 102*b*, provided with a 1:1 gear ratio, which will result in an arc-shaped pathway S for the load 10 as the actuation system 170 drives the linear drive element 160. As such, the configuration associated with the third embodiment may be referred to as a non-linear drive configuration. The gear structure 140 associated with the second carriage arm 102*b* may also be configured similarly with two pinion gears 144, 146. In such an application, the movement of the carriage arms 102*a*, 102*b* would be synchronized together in a linear fashion, but with an effective gear ratio of 2:1 wherein the arms 102*a*, 102*b* move at an incremental distance that is double that of the linear drive element 160.

Figure 4:
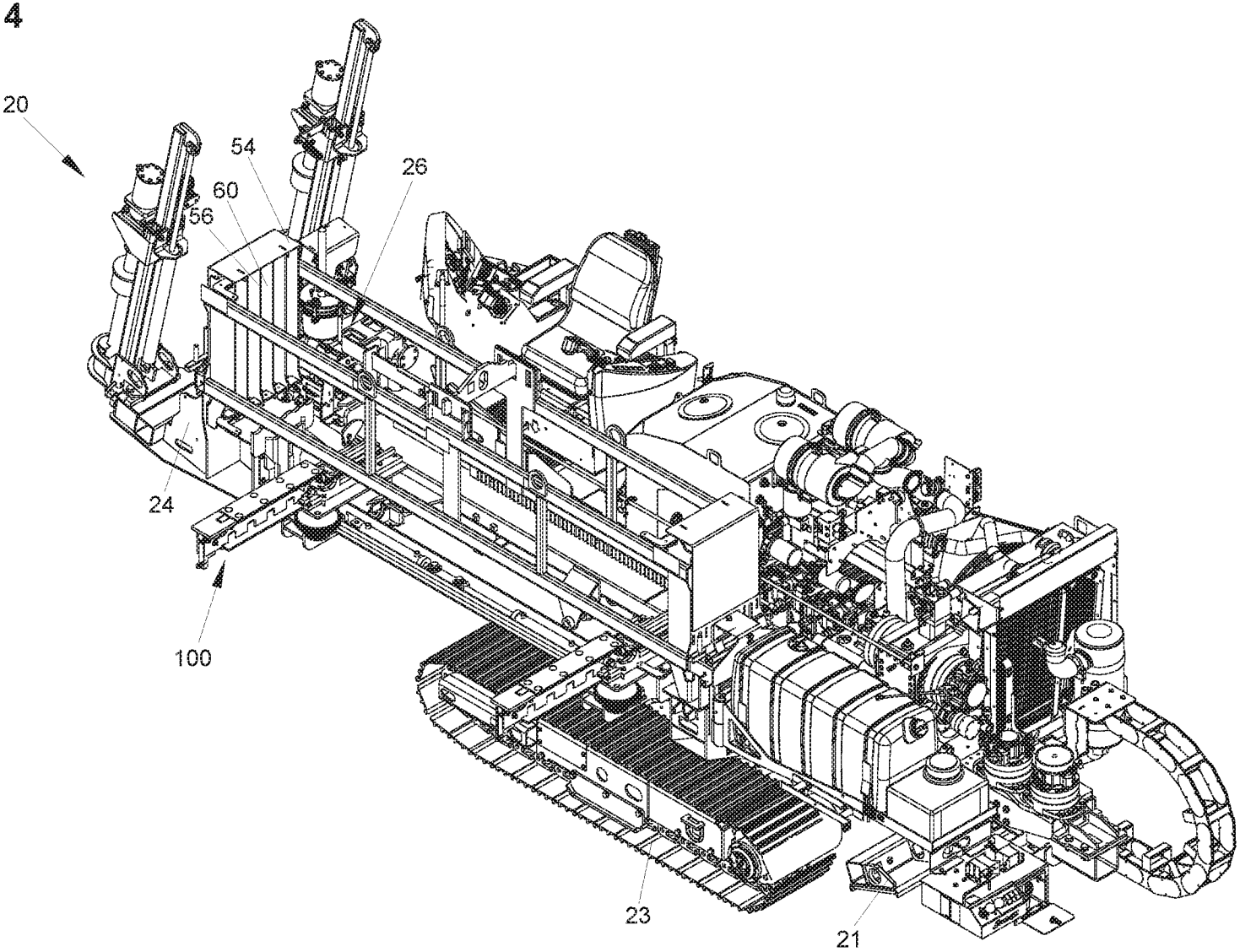
FIG. 4 is a perspective view of a fourth embodiment of a positionable carriage assembly having features of the disclosed invention, the assembly being mounted to a directional drilling machine.
Figure 5:
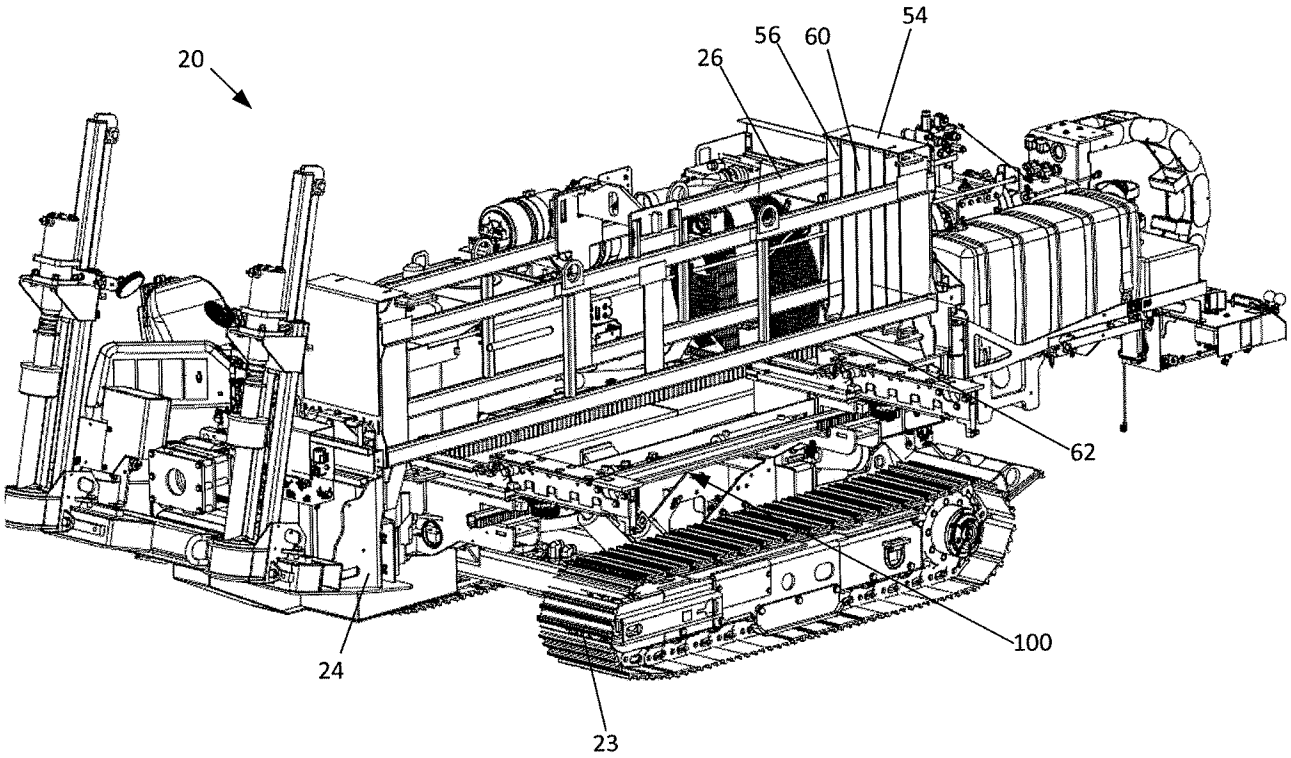
FIG. 5 is a perspective view of the positionable carriage assembly and directional drilling machine of FIG. 4.
Figure 6:
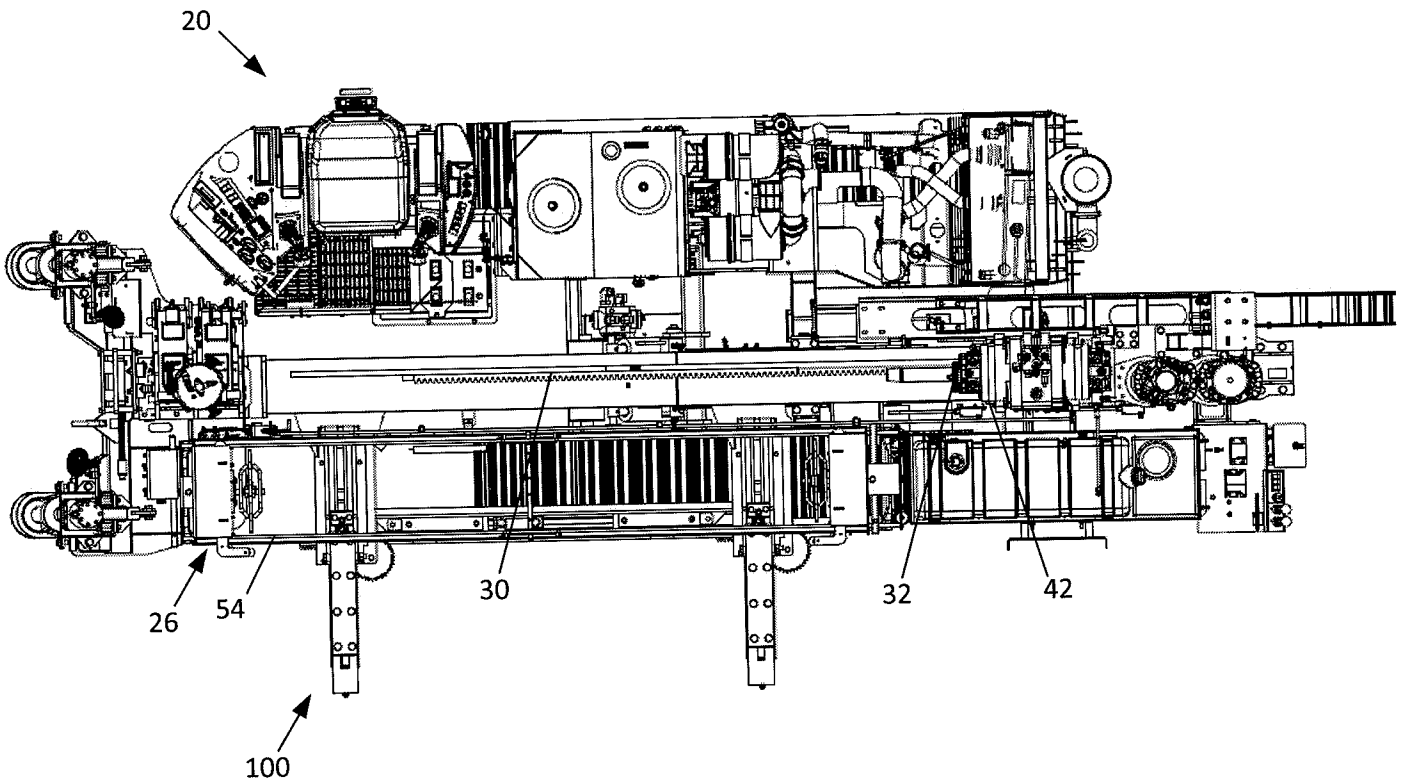
FIG. 6 is a top view of the positionable carriage assembly and directional drilling machine of FIG. 4.
Figure 7:
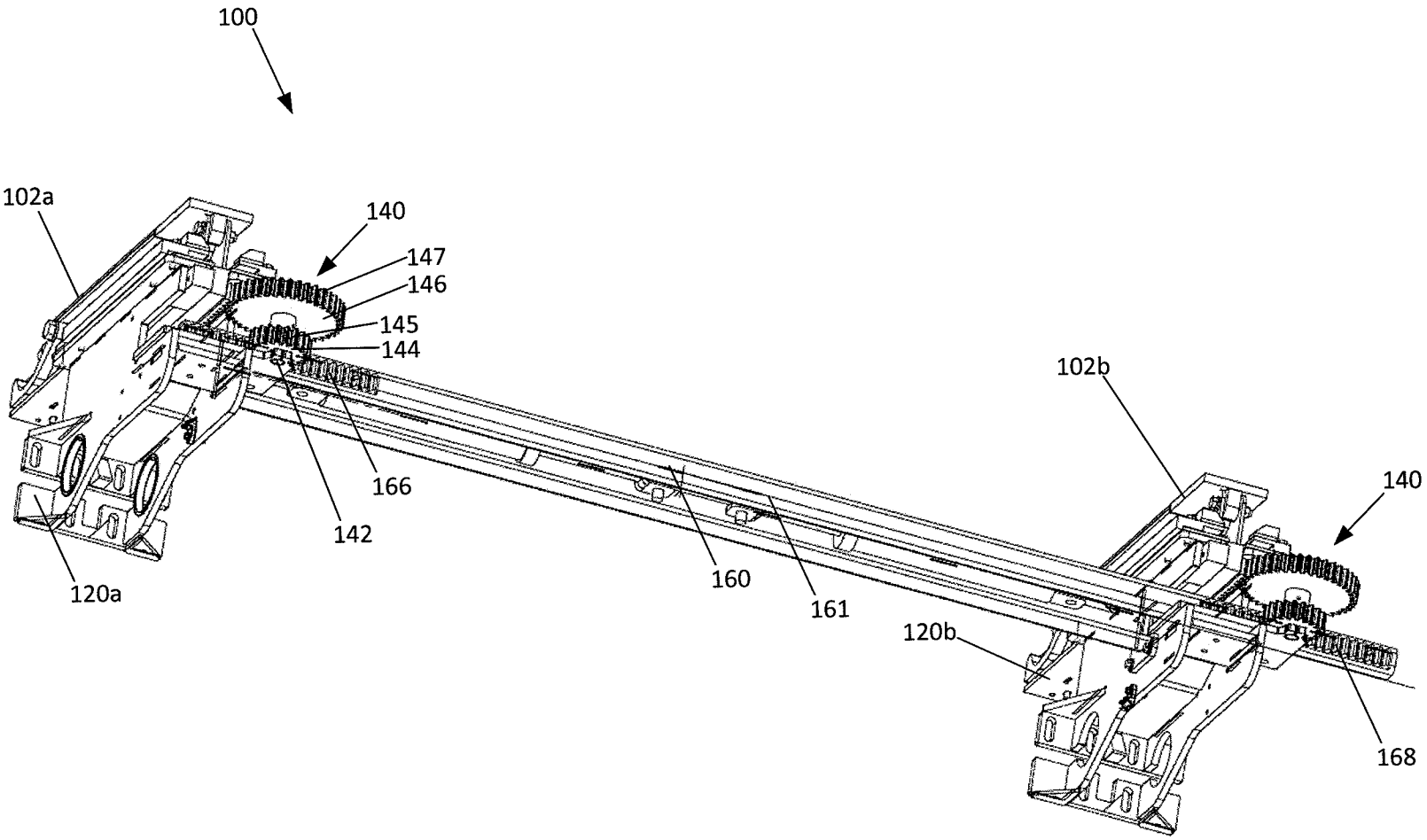
FIG. 7 is a perspective view of the carriage assembly shown in FIG. 4.
Figure 8:
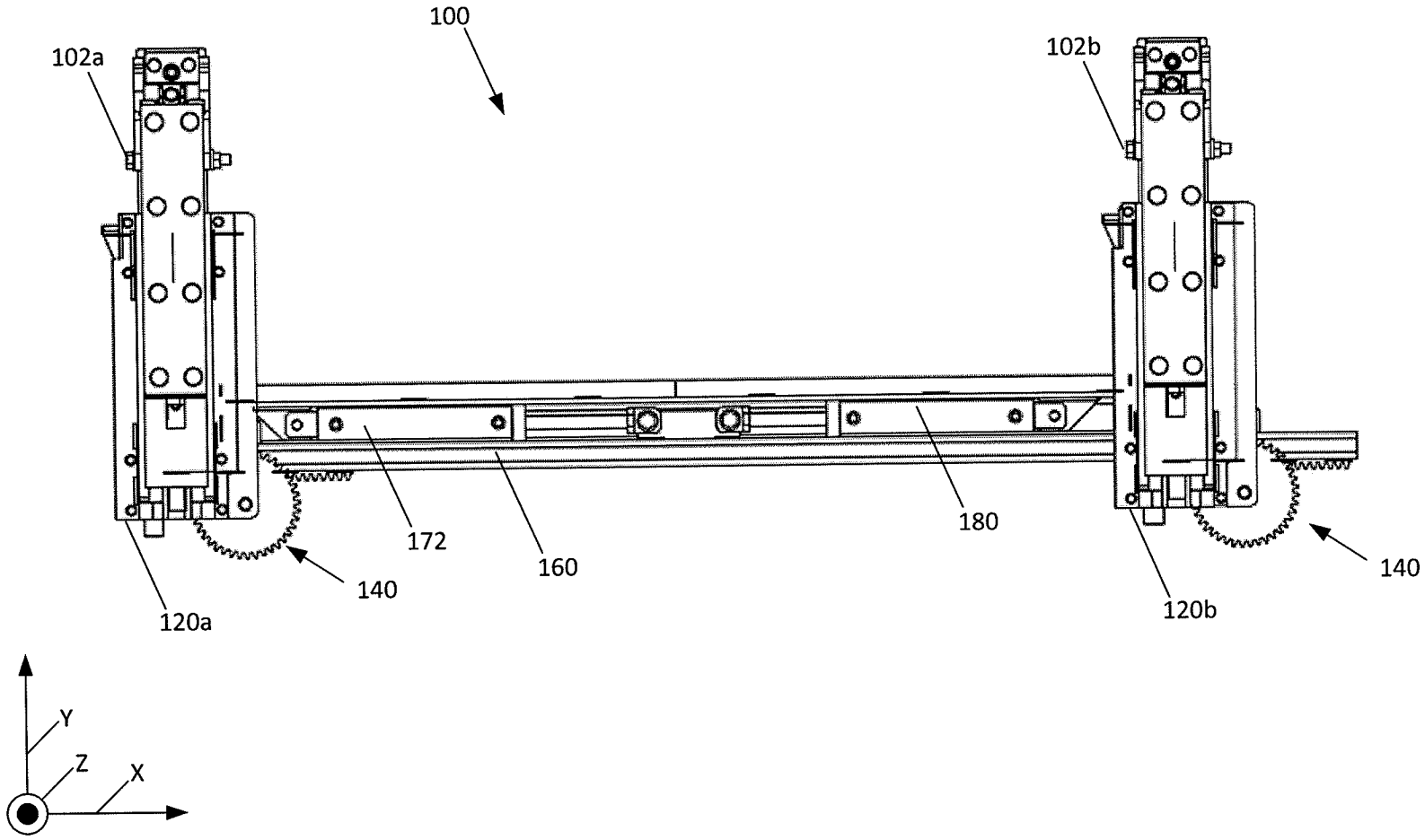
FIG. 8 is a top view of the carriage assembly of FIG. 7.
Figure 9:
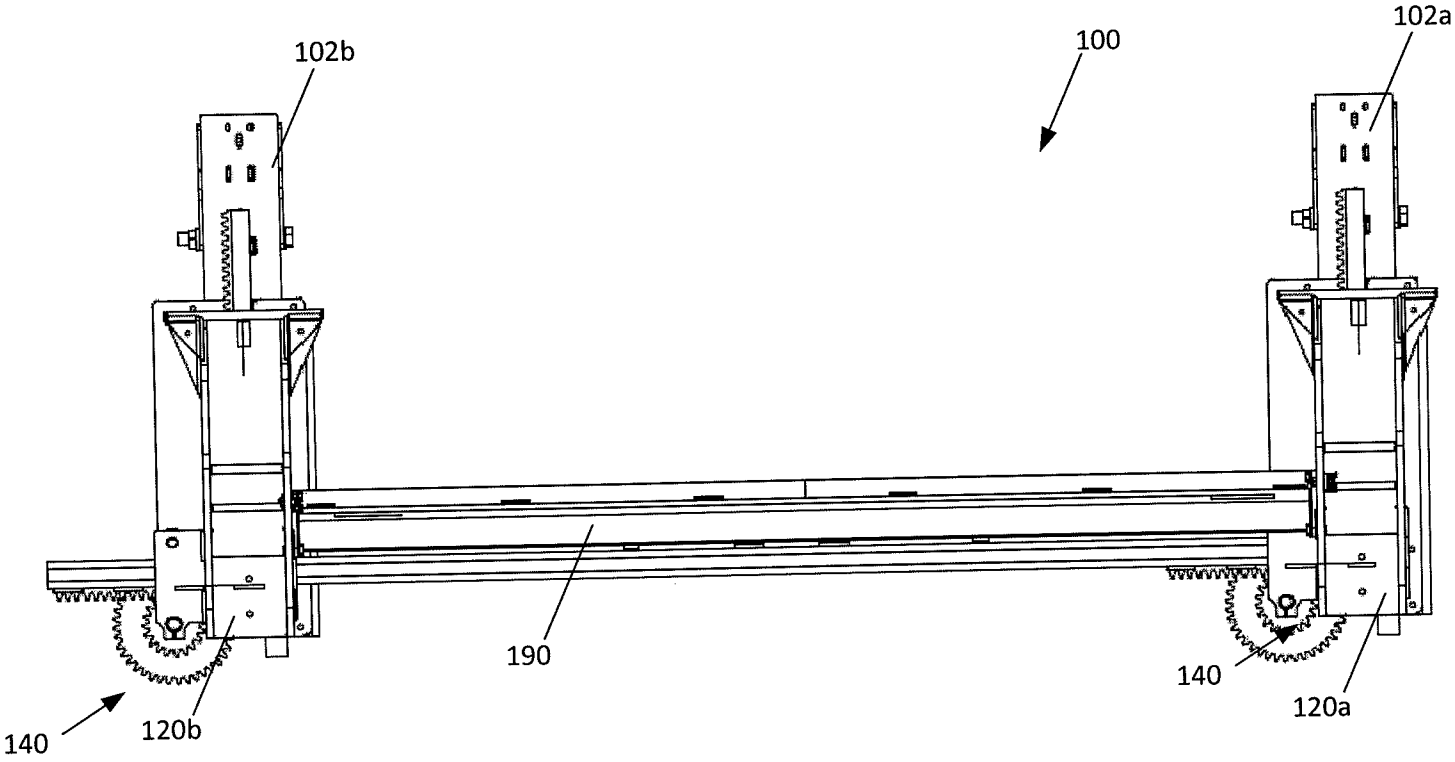
FIG. 9 is a bottom view of the carriage assembly of FIG. 7.
Figure 10:
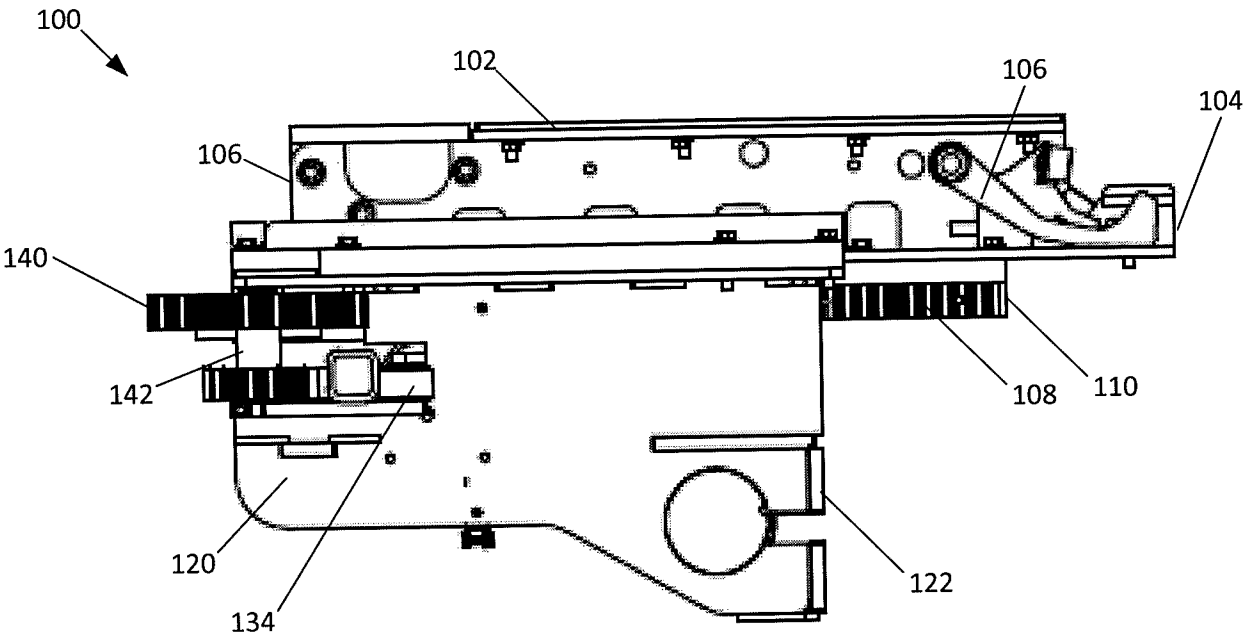
FIG. 10 is a left side view of the carriage assembly of FIG. 7.
Figure 10A:
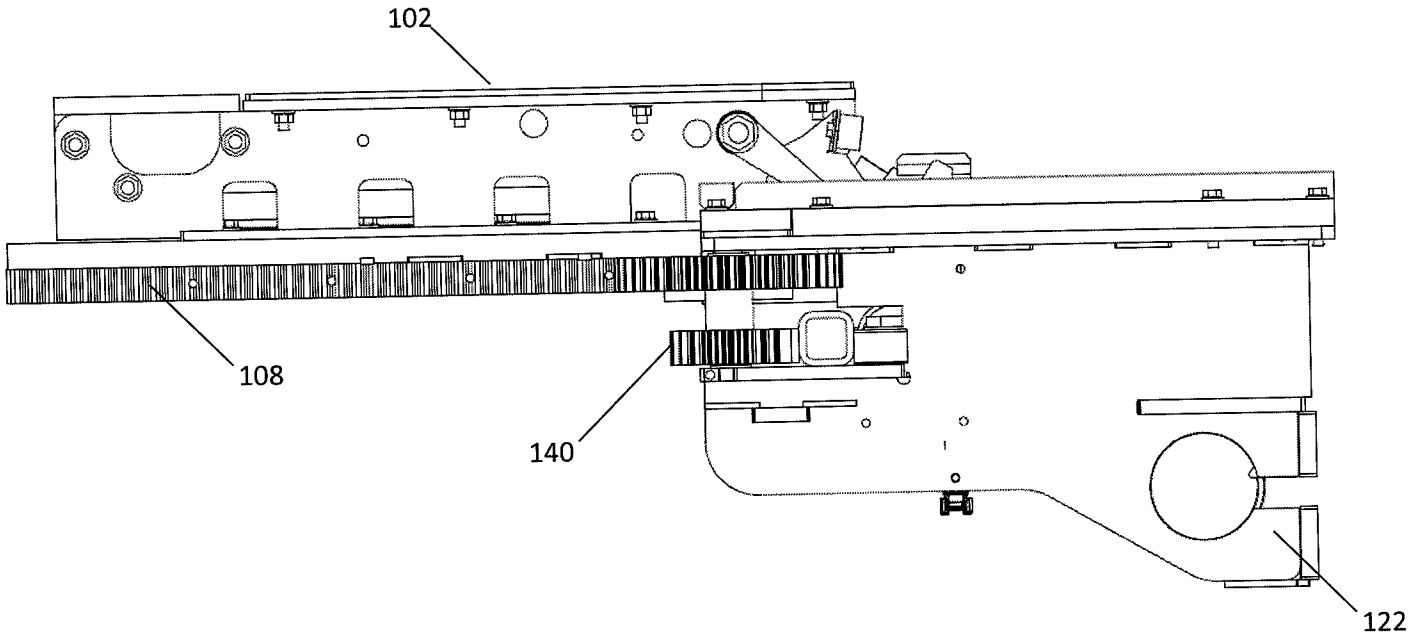
FIG. 10A is a left side view of the carriage assembly of FIG. 7 with the carriage arm being in an extended position.
Figure 11:
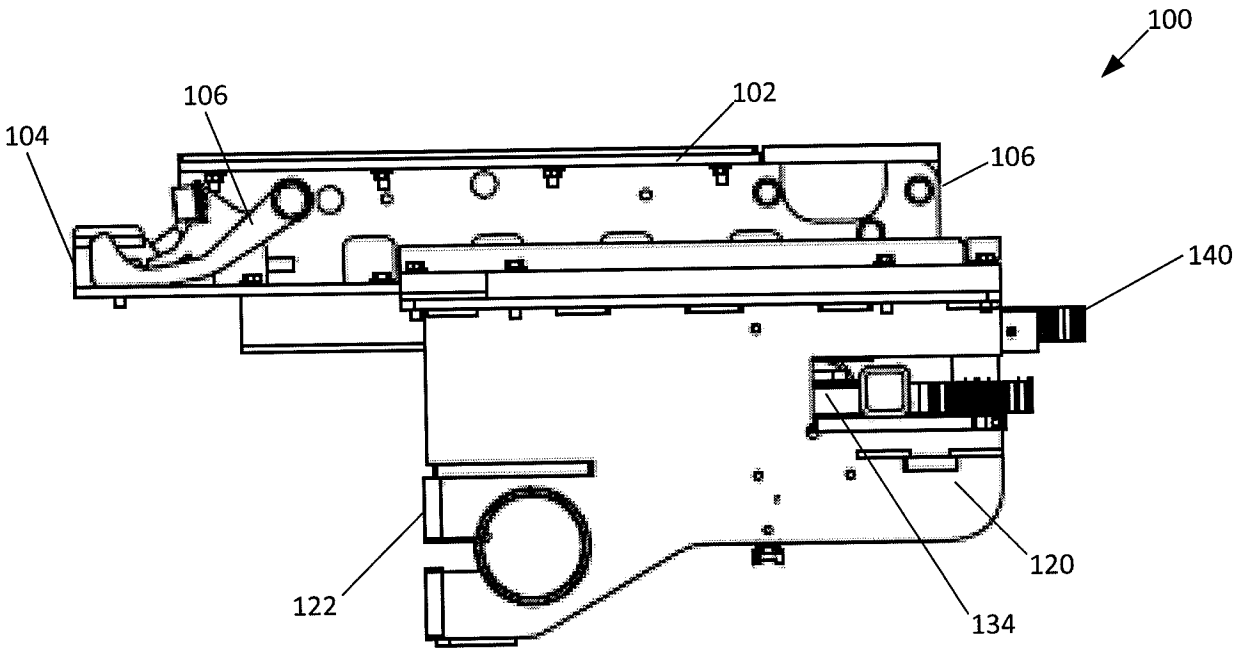
FIG. 11 is a right side view of the carriage assembly of FIG. 7.
Figure 12:
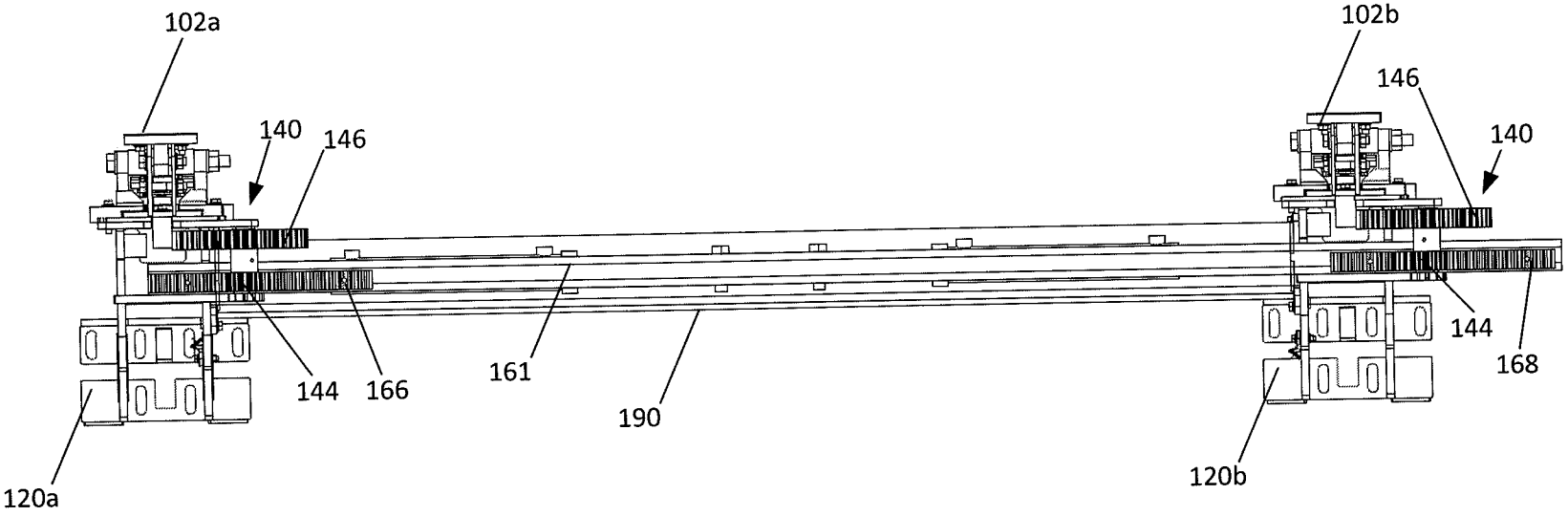
FIG. 12 is a front view of the carriage assembly of FIG. 7.
Figure 13:
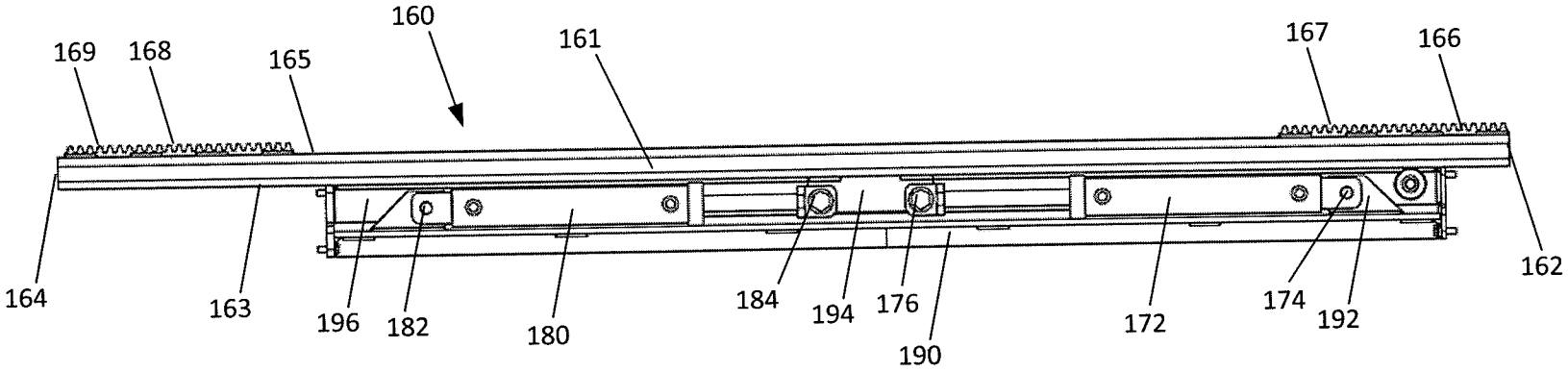
FIG. 13 is a top view of a portion of the carriage assembly of FIG. 7.
Figure 15:
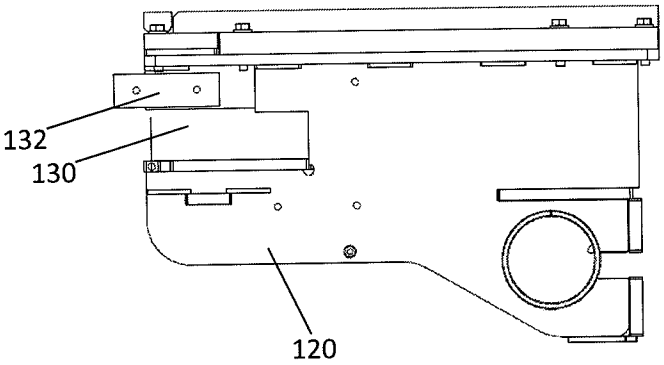
FIG. 15 is a side view of the mounting bracket of FIG. 14.
Figure 16:
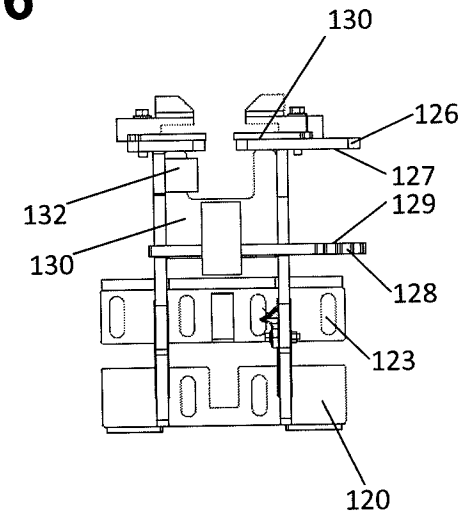
FIG. 16 is a side view of the mounting bracket of FIG. 14.
Figure 14:
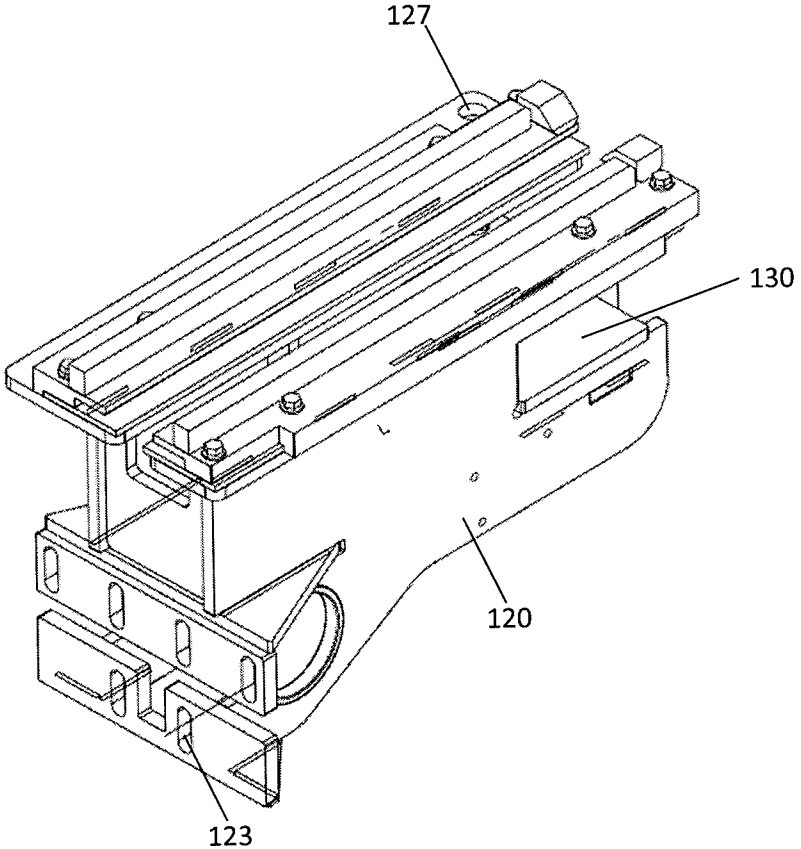
FIG. 14 is a perspective view of a mounting arm of the carriage assembly shown in FIG. 4.
Figure 18:
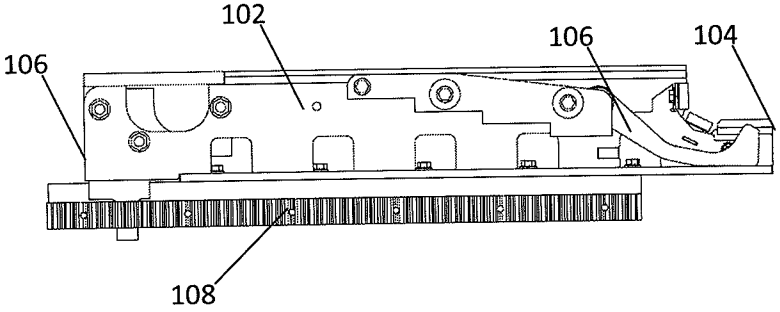
FIG. 18 is a side view of the loader arm of FIG. 17.
Figure 19:
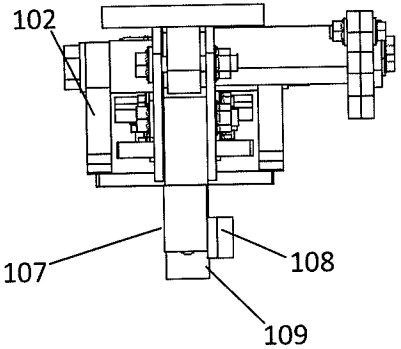
FIG. 19 is a side view of the loader arm of FIG. 17.
Figure 17:
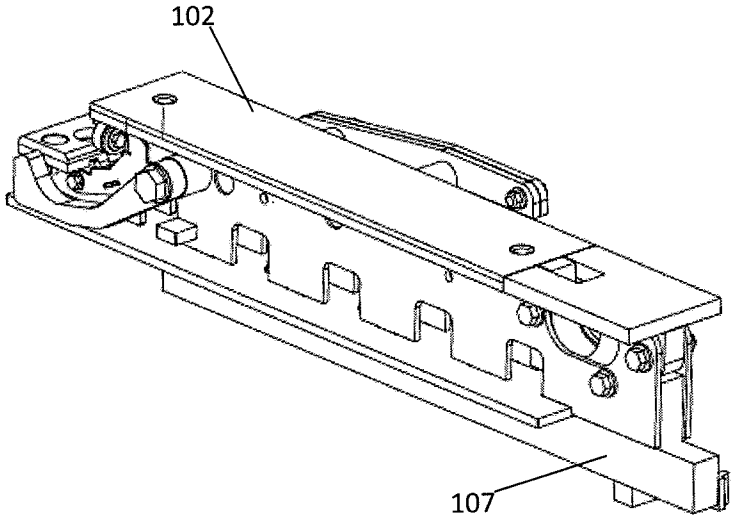
FIG. 17 is a perspective view of a loader arm of the carriage assembly shown in FIG. 4.

Referring to FIGS. 4-22, a fourth embodiment of a positionable carriage assembly 100 is shown in which the positionable carriage assembly 100 can be configured for use with a drilling apparatus 20. The fourth embodiment is similar to certain aspects of the first and third embodiments. Therefore, the description for the first and third embodiments is applicable to the fourth embodiment. Referring to FIGS. 4-6, a drilling apparatus 20 (e.g., a directional boring machine), constructed in accordance with the principles of the present invention, is shown. In one aspect, the drilling apparatus 20 includes a positionable carriage assembly 100 configured to move pipes between a drill rod loader box or storage magazine 26 and a drive head assembly 32. In one example, the positionable carriage assembly 100 supports and selectively positions the drill rod loader box or storage magazine 26. Accordingly, the positionable carriage assembly 100 may also be referred to as a rod carrying mechanism 100 or a loader box carrying mechanism. The drilling apparatus 20 may also include a pair of drive tracks 23 for propelling the drilling apparatus 20 along the ground. The drive tracks 23 support a main chassis 21 of the drilling apparatus. A frame 24 is mounted to the main chassis 21 and supports the drill rod magazine. For the purpose of clarity, the drill rod magazine 26 is shown without any stored pipes. A pair of carriage or loader arms 102, which may also be referred to as rod support members 102, of the positionable carriage assembly 100 is used to convey pipes between the magazine 26 and the drive head assembly 32 of the drilling apparatus 20.

The drilling apparatus 20 is used to push a drill string of pipes into the ground to bore a hole. To start the drilling sequence, the frame 24 is pivoted relative to the drive tracks 23 such that the elongated track 30 is inclined relative to the ground. Also, a drive head carriage 42 is moved to a start position adjacent an upper end of the track 30. A first pipe is then removed from the magazine 26 by the arms 102 and placed in coaxial alignment with the drive head assembly 32. With the pipe aligned along the drive axis of the drive head assembly 32, one end of the pipe is coupled to the drive head assembly 32. Preferably, a cutting member (e.g., a drill head) is positioned at the other end of the pipe. Once the pipe has been coupled to the drive head assembly 32, the arms 102 are retracted and the drive head rotates the pipe. Concurrently, a thrust step is initiated such that the rotating pipe is drilled into the ground. During the thrust step, the drive mechanism moves the carriage 100 along the track 30. As is conventionally known in the art, drilling fluids can be used to facilitate drilling operations.

After the thrust step has been completed, the drive head assembly 32 is uncoupled from the pipe and a return/pull step is initiated such that the drive head carriage 42 returns to the start position along the track 30. With the drive head carriage 42 returned to the start position, a second pipe can be removed from the magazine 26 and placed in coaxial alignment with the drive axis of the drive head assembly 32. As so aligned, the second pipe is coupled to both the drive head assembly 32 and the first pipe to form a drill string. Thereafter, a thrust step is again initiated such that the entire drill string is pushed further into the ground. By repeating the above steps, additional pipes can be added to the drill string thereby increasing the length of the hole that is being drilled by the drilling apparatus.

Once the hole has been drilled to a desired length, it is common to enlarge the hole through a back reaming process. For example, a back reamer can be attached to the distal end of the drill string. Additionally, product desired to be placed in the hole (e.g., a cable, a duct or the like) can also be connected to the distal end of the drill string. The drill string is then rotated and pulled back toward the drilling apparatus by the drive head assembly 32. For example, the drive head assembly 32 is connected to the drill string and then a return/pull step is initiated causing drill string to be pulled in the return direction. As the drill string is pulled back to the drilling apparatus 20, the back reamer enlarges the previously drilled hole and the product is pulled into the enlarged hole. With each pull/return step, a pipe is removed from the ground. After a pipe has been withdrawn from the ground, the arms 102 are extended. The extracted pipes are then uncoupled from the drill string, and the arms 102 are retracted to convey the pipes back to the magazine 26.

Still referring to FIGS. 4-6, the magazine 26 of the drilling apparatus 20 includes a box-shaped frame 54 having a plurality of dividing walls 56. The walls 56 divide the magazine 26 into a plurality of columns 60. The column nearest the drive head assembly 32 is referred to as a first column. The column 60 farthest from the drive head assembly 32 is referred to as an end column. Each of the columns 60 are each configured to hold a plurality of pipes with the pipes aligned stacked vertically within each of the columns and with the pipes axes parallel to the drive axis of the drive head assembly 32. The magazine 26 has a bottom end 62 that is open such that the spaces between the dividing walls 56 define a plurality of discharge openings.

Referring to FIGS. 4-22, the positionable carriage assembly 100 is shown in greater detail. Although the positionable carriage assembly 100 is shown and described as being associated with drilling apparatus 20 to convey pipes between the magazine 26 and the drive head assembly 32, it is again noted that the positionable carriage assembly 100 is not limited to such a use. Rather, the positionable carriage assembly 100 may be used in any application where it is desirable to have simultaneous, coordinated movement and/or synchronized movement between two carriage elements or arms 102. For example, the positionable carriage assembly 100 may be utilized in conjunction with a camper slide-out system wherein the carriage arms 102 support a slide-out section of a camper.

As with the first through third embodiments, the carriage arms 102 of the positionable carriage assembly 100 for the fourth embodiment are shown as including a first carriage arm 102*a* and a second carriage arm 102*b*. Accordingly, the carriage arms 102 are configured with a first end 104, a second end 106, a first side 107, and a second side 109. Where the carriage arms 102 are configured as loader arms, the carriage arms 102 may be provided with a catch mechanism 106 for retaining pipes from the magazine 26, Each carriage arm 102 is also shown as being provided with a gear rack 108 on the carriage arm second side 109. In one aspect, the gear rack 108 is provided with a plurality of teeth 110 extending along the length of the rack 108. As discussed in more detail later, the teeth 110 of the gear rack 108 engage with the teeth of a gear structure 140 such that operation of the gear structure 140 imparts a movement onto the carriage arm 102 via the gear rack 108.

In one aspect, each carriage arm 102 is slidably supported by a support bracket 120 (120*a*, 120*b*). The support bracket 120 supports the carriage arm 102 and also acts as a guide to allow the carriage arm 102 to slide in a direction parallel to an axis Y between a retracted orientation (see FIGS. 7-10) and an extended orientation (see FIGS. 4-6 and 10A). In the retracted orientation, the majority of the length of the carriage arm 102 is above and overlapping the support bracket 120, while, in the extended orientation, the majority of the length of the carriage arm 102 is extended beyond the support bracket 120. The support brackets 120*a*, 120*b* shown in the drawings have a substantially identical configuration. As the configurations are the same, each individual bracket 120*a*, 120*b*, may be referred to as bracket 102 with the description being applicable to both brackets 120*a*, 120*b*. It is noted that the configuration of the brackets 120 need not be identical to the other. For example, the brackets 120 may be mirror reproductions of each other.

In one aspect, the support bracket 120 includes a first end 122 and a second end 124. As shown, the first end 122 is configured as a mounting surface at which the positionable carriage assembly 100 can be mounted to the drilling apparatus 20. As shown, the first end 122 is provided with a plurality of mounting holes 123 such that the support bracket 120 can be secured to the drilling apparatus 20 via mechanical fasteners, such as bolts. The support bracket 120 may be alternatively attached by other means, such as by welding. Proximate the second end 124, the support bracket 120 is configured to support the gear structure via an upper arm 126 and a lower arm 128 having respective through holes 127, 129 through which a pin 142 of the gear structure 140 extends. The lower arm 128 also provides a support surface for a linear drive element 160, discussed later, that transversely extends through a recess 130 in the support bracket 120.

As shown, the support bracket 120 may also be provided with a first alignment element 132. The first alignment element 132 is mounted to the support bracket 120 and positioned against the first side 107 of the carriage arm 120 (i.e. on a side opposite the side that the rack 108 is mounted to the carriage arm 120). In such a configuration, the first alignment element 132 ensures that the rack 108 remains fully engaged against the gear structure 140 by limiting the transverse movement of the carriage arm 102 away from the gear structure 140. Accordingly, as the carriage arm 102 slides between the extended and retracted positions, the carriage arm 102 slides against the first alignment element 132, which provides a transverse force on the carriage arm 102 in a direction towards the gear structure. As shown, the first alignment element 132 is configured as a rubber bushing. However, alternative alignment element configurations are possible, such as using one or more rollers or bearing structures.

Each support bracket 120 may also be provided with a second alignment element 134. The second alignment element 134 is mounted to the support bracket 120 and is positioned to ensure proper engagement of the linear drive element 160 against each gear structure 140. As shown, the second alignment element 134 is configured as a roller. However, alternative alignment element configurations are possible, such as using one or more bushings or bearing structures.

As with the first through third embodiments, the linear drive element 160 of the fourth embodiment is configured as a rigid elongate member or bar 161 having first and second sides 163, 165 extending between first and second ends 162, 164. Accordingly, the linear drive element 160 reciprocally translates in a direction parallel to the length of the linear drive element 160 and parallel to an axis X. In the embodiment shown, the axis X and the axis Y are generally orthogonal to each other. As shown, a gear rack 166 is provided on the first side 163 of the linear drive element 160 proximate the first end 162, while a gear rack 168 is provided on the first side 163 of the linear drive element 160 proximate the second end 164. Accordingly, the elongate member or bar 161 interconnects the gear racks 166, 168 such that they are co-linearly arranged along a common longitudinal axis. As with gear racks 108, each gear rack 166, 168 is respectively provided with a plurality of teeth 167, 169 extending along the length of the gear rack 166, 168. 108. As configured, the teeth 167 of the gear rack 166 engage with teeth of the gear structure 140 associated with the first carriage arm 102*a* and the teeth 169 of the gear rack 166 engage with the teeth of the gear structure 140 associated with the second carriage arm 102*b*.

As stated previously, each gear structure 140 is mounted to the support bracket 120 via a central pin 142. In operation, each of the gear structures 140 rotates about an axis that is parallel to an axis Z which is shown as being generally orthogonal to axis X and to axis Y. In the exemplary embodiment shown, the gear structure 140 includes a first pinion gear 144 having a plurality of teeth 145 and a second pinion gear 146 having a plurality of teeth 147. As shown, the first and second pinion gears 144, 146 are rigidly interconnected. For the gear structure 140 associated with the first carriage member 102*a*, the teeth 145 of the first pinion gear 144 operably intermesh the teeth 167 of the gear rack 166. For the gear structure 140 associated with the second carriage member 102*b*, the teeth 145 of the first pinion gear 144 operably intermesh with the teeth 169 of the gear rack 168. For both gear structure 140, the teeth 147 of the second pinion gear 146 operably intermesh with the teeth 110 of the respective gear rack 108 on the carriage arm 102*a*, 102*b*. In one aspect, the gear structures 140 and gear racks 110, 166, 168 may be collectively referred to as a gear drive assembly.

As the gear racks 166 and 168 are each connected to the rigid linear drive element 160, any translation of the linear drive element 160 towards the first or second end 162, 164 will result in the synchronized movement of both of the carriage arms 102*a*, 102*b*. In operation, movement of the linear drive element 160 towards the first or second end 162, 164 and parallel to the axis X imparts a rotational movement onto each of the gear structures 140 about an axis parallel to axis Z. The rotation of the gear structures 140, in turn, imparts a linear movement onto each of the carriage arms 102*a*, 102*b* in a direction that is parallel to the axis Y. Resultantly, a linear translation of the linear drive element 160 along a first axis imparts a corresponding linear translation of both carriage arms 102*a*, 102*b* along a second axis orthogonal to the first axis. In the exemplary embodiment shown, the gear drive assembly is configured such that translation of the linear drive element 160 in a direction towards the first end 162 results in the carriage arms 102 being moved towards the extended orientation, while translation of the linear drive element 160 in a direction towards the second end 164 results in the carriage arms 102 being synchronously moved towards the retracted orientation. However, it should be noted that the gear drive assembly could be configured to produce the opposite action without departing from the concepts presented herein.

In the embodiment shown, the pitches of the teeth 110, 145, 147, 167, and 169 are all equal and the first pinion gear 144 of the gear structure 140 is about half the size of the second pinion gear 146 of the gear structure. This configuration results in an effective 2:1 gear ratio between the gear racks 166, 168 and the respective gear rack 110, meaning that for every unit length movement of the linear drive element 160, the carriage arms 102 will move two unit lengths. However, it is noted that any other desired gear ratio may be implemented to suit a particular application. It is also noted that the gear structure 140 could be provided with a single continuous gear extending between the gear racks 166, 168 and the respective gear rack 110, as is schematically shown at FIG. 1. In such an implementation, the gear ratio between the gear racks 166, 168 and the respective gear rack 110 would be 1:1.

In one aspect, the positionable carriage assembly 100 can also be provided with an actuation system 170 to reciprocally operate the linear drive element 160. The actuation system 170 may also be referred to as a drive mechanism 170. As most easily seen at FIG. 13, the actuation system 170 may include a first actuator 172 and a second actuator 180. However, more or fewer actuators may be used. In a preferred embodiment, the first and second actuators 172, 180 are configured as linear hydraulic actuators with each having a cylinder 172*a*, 180*a*, a rod 172*b*, 180*b* within the respective cylinder 172*a*, 180*a*, and a piston 172*c*, 180*c* connected to the respective rod 172*b*, 180*b*. Other types of actuators may be used, although with reduced positional accuracy in some instances.

As shown, a support beam 190 is provided to support the actuation system 170 and extends between and is connected to the first and second support brackets 120*a*, 120*b*. The support beam 190 may be connected to the support brackets 120 by any desired means, such as by mechanical fasteners or by welding. Alternatively, the actuation system 170 could be mounted directly to the drilling apparatus 20 without the need for the support beam 190.

As shown, the first actuator 172 has a first end 174 and a second end 176, while the second actuator 180 has a first end 182 and a second end 184. The first actuator 172 is connected to an anchor point 192 of the support beam 190 at the first end 174 and is connected to an anchor point 194 of the linear drive element 160 at the second end 176. The second actuator 180 is connected to an anchor point 196 of the support beam 190 at the first end 182 and is connected to the anchor point 194 of the linear drive element 160 at the second end 184. The first and second actuators 172, 180 are aligned to extend and retract in a direction that is parallel to the length of the linear drive element 160 (i.e. parallel to axis X). Accordingly, extension or retraction of the actuators 172, 180 will impart a movement onto the linear drive element 160 towards the first or second end 162, 164 depending upon the actuation direction.

In the configuration shown, the first and second actuators 172, 180 are placed in opposition to each other such that extending the rod 172*b* of the first actuator 172 requires the coordinated retraction of the rod 180*b* of the second actuator 180, and vice versa. Accordingly, the actuators 172, 180 are configured such that while one is powered to retract, the other is powered to extend such that the actuators 172, 180 work cooperatively, and the combined power of the actuators 172, 180 is delivered to the linear drive element 160.

Figure 21:
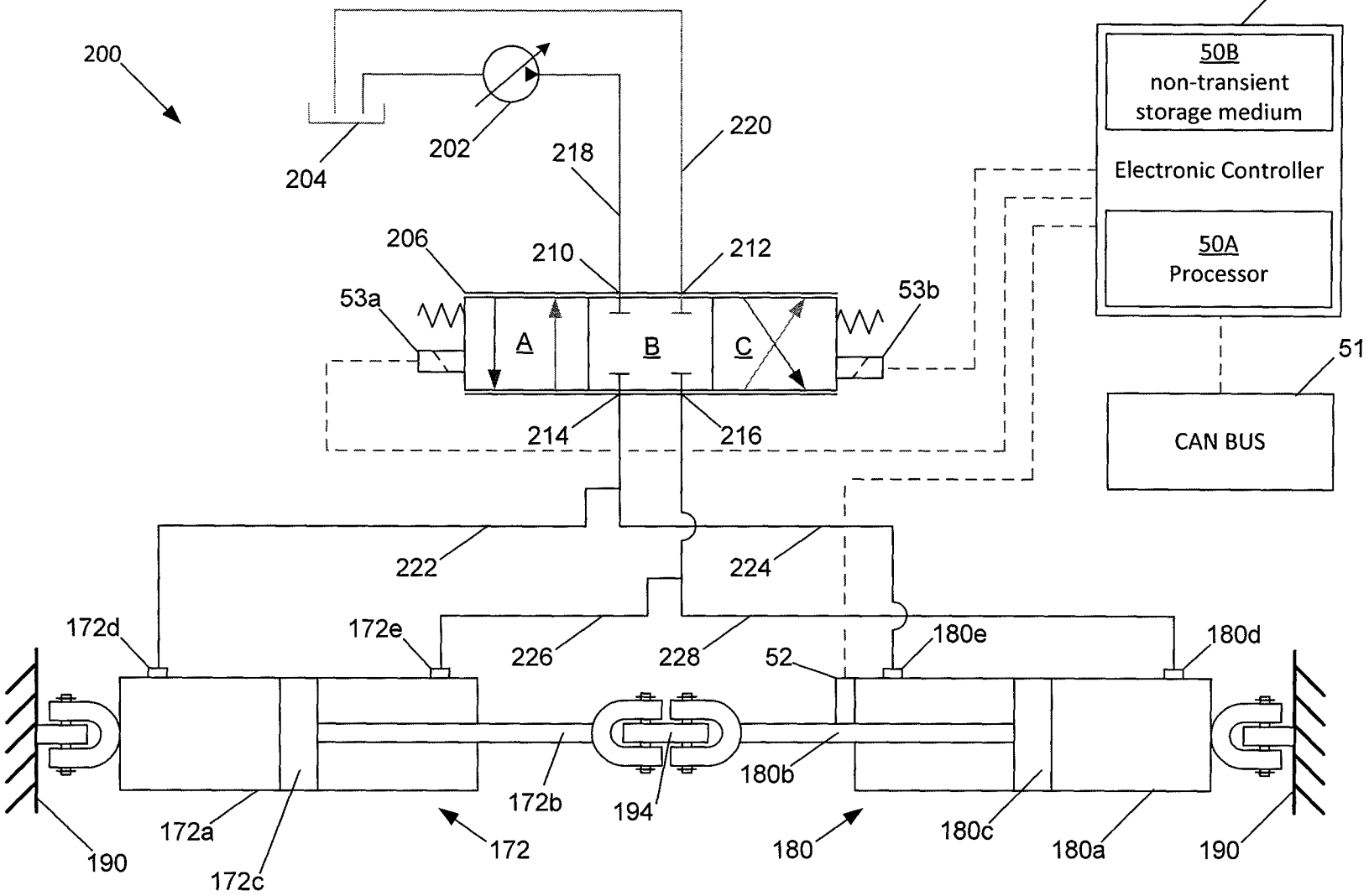
FIG. 21 is a hydraulic and control schematic relating to the carriage assembly of FIG. 7.

Referring to FIG. 21, a schematic is presented of the hydraulic and control system 200 associated with the positionable carriage assembly 100. As shown, a hydraulic pump 202 and a fluid reservoir 204 are selectively placed in fluid communication with the first and second actuators 172, 180 via a control valve 206. In one aspect, the valve 206 is a four-way, three-position valve having ports 210, 212, 214, 216 and positions A, B, C. The port 210 is shown as being in fluid communication with the pump 202 via branch line 218, while the port 212 is shown as being in fluid communication with the reservoir via branch line 220. The port 214 is in fluid communication with a first port 172*d* of the first actuator 172 via branch line 222 and with a second port 180*e* of the second actuator 180 via branch line 224. The port 216 is in fluid communication with a second port 172*e* of the first actuator 172 via branch line 226 and with a first port 180*d* of the second actuator 180 via branch line 228.

In position A, the control valve 206 places the ports 210 and 214 in fluid communication with each other and places ports 212 and 216 in fluid communication with each other. Resultantly, the pump 202 is placed in fluid communication with ports 172*d* and 180*e* of the actuators 172, 180, and the reservoir 204 is placed in fluid communication with the ports 172*e* and 180*d* of the actuators 172, 180. In this position, the first actuator 172 is driven by the pump 202 to extend, and the second actuator 180 is driven by the pump 202 to retract which results in the linear drive element 160 being driven in a first direction.

In position B, the control valve 206 isolates the ports 210, 212, 214, 216 from each other such that no fluid communication exists between the pump 202 and the actuators 172, 180 nor between the reservoir 204 and the actuators 172, 180. Thus, the actuators 172, 180 are prevented from moving by the control valve 206 when the valve is in position B.

In position C, the control valve 206 places the ports 210 and 216 in fluid communication with each other and places ports 210 and 216 in fluid communication with each other. Resultantly, the pump 202 is placed in fluid communication with ports 172*e* and 180*d* of the actuators 172, 180, and the reservoir 204 is placed in fluid communication with the ports 172*d* and 180*e* of the actuators 172, 180. In this position, the first actuator 172 is driven by the pump 202 to retract, and the second actuator 180 is driven by the pump 202 to extend, which results in the linear drive element 160 being driven in a second direction opposite the first direction.

As the volume of the actuator within the cylinders 172*a*, 180*a* on the rod side of the pistons 172*c*, 180*c* is reduced by the volume of the rod 172*b*, 180*b*, the fluid flow and associated power output of the actuator is reduced when retracting the actuator as compared to extending the actuator. By orienting two actuators 172, 180 in opposition to each other and by directing fluid flow as described above, the resulting combined fluid flow through the valve 206 and power output to the linear drive element 160 from the actuators 172, 180 is the same regardless of the desired drive direction for the linear drive element 160. Accordingly, the actuation system is inherently balanced which simplifies the control and operation of the system. Additionally, utilizing two smaller actuators 172, 180 instead of a single larger actuator to achieve the power output requirement to the linear drive element 160, the positionable carriage assembly 100 can be constructed in a more economical and compact manner.

Electronic Control System

An electronic control system can be provided that monitors, initiates, and controls the initiation of the positionable carriage assembly 100. In one example, an electronic controller 50 monitors various sensors and operating parameters of the positionable carriage assembly 100 to ensure optimal and proper operation.

Figure 20:
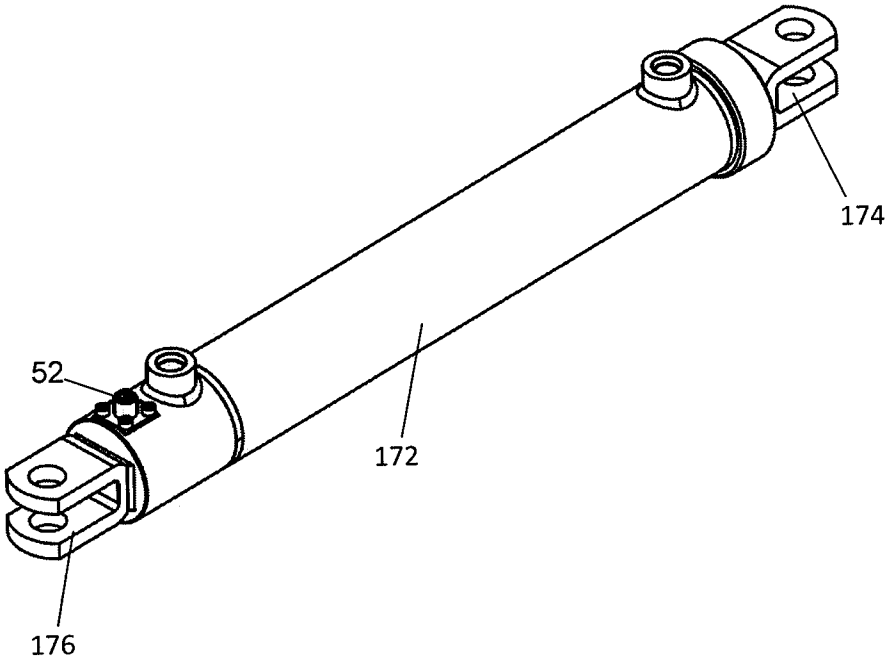
FIG. 20 is a perspective view of an actuator usable in the carriage assembly of FIG. 7.

Referring to FIG. 21, the electronic controller 50 is schematically shown as including a processor 50A and a non-transient storage medium or memory 50B, such as RAM, flash drive or a hard drive. Memory 50B is for storing executable code, the operating parameters, and potential inputs from an operator interface, while processor 50A is for executing the code. Electronic controller 50 is configured to be connected to a number of inputs and outputs that may, for example, be used for implementing the bypass operational modes. For example, the electronic controller 50 can receive information from a vehicle control area network (CAN) bus 51 and information from sensors associated with the positionable carriage assembly 100. For example, one or both of the actuators 172, 180 may be provided with a position sensor 52 such that the position of the carriage arms 102 can be calculated. Referring to FIG. 20, an exemplary actuator 172 is shown including an integrated Hall Effect type sensor 52. Such an actuator, with or without the sensor 52, is available from Columbus Hydraulics of Columbus, Nebr. Alternatively, or in addition, one or both of the carriage arms 102 can also be provided with position sensors. One skilled in the art will understand that many other inputs and methods of obtaining position feedback are possible. For example, other forms or position sensors can be used, switches can be added to sense the position of the rack gears, and inductive sensors can be used to detect movement of the rack gears.

Examples of outputs from the controller 50 are outputs for the operation of the control valve 206. For example, the control valve 206 may be provided with a first solenoid actuator 53*a* and/or a second solenoid actuator 53*b* to operate the control valve between positions A, B, and C. Other outputs are possible as well. In one embodiment, the electronic controller 50 is configured to include all required operational outputs for the operation of the positionable carriage assembly 100. The electronic controller 50 may also include a number of maps or algorithms to correlate the inputs and outputs of the controller 50.

Figure 22:
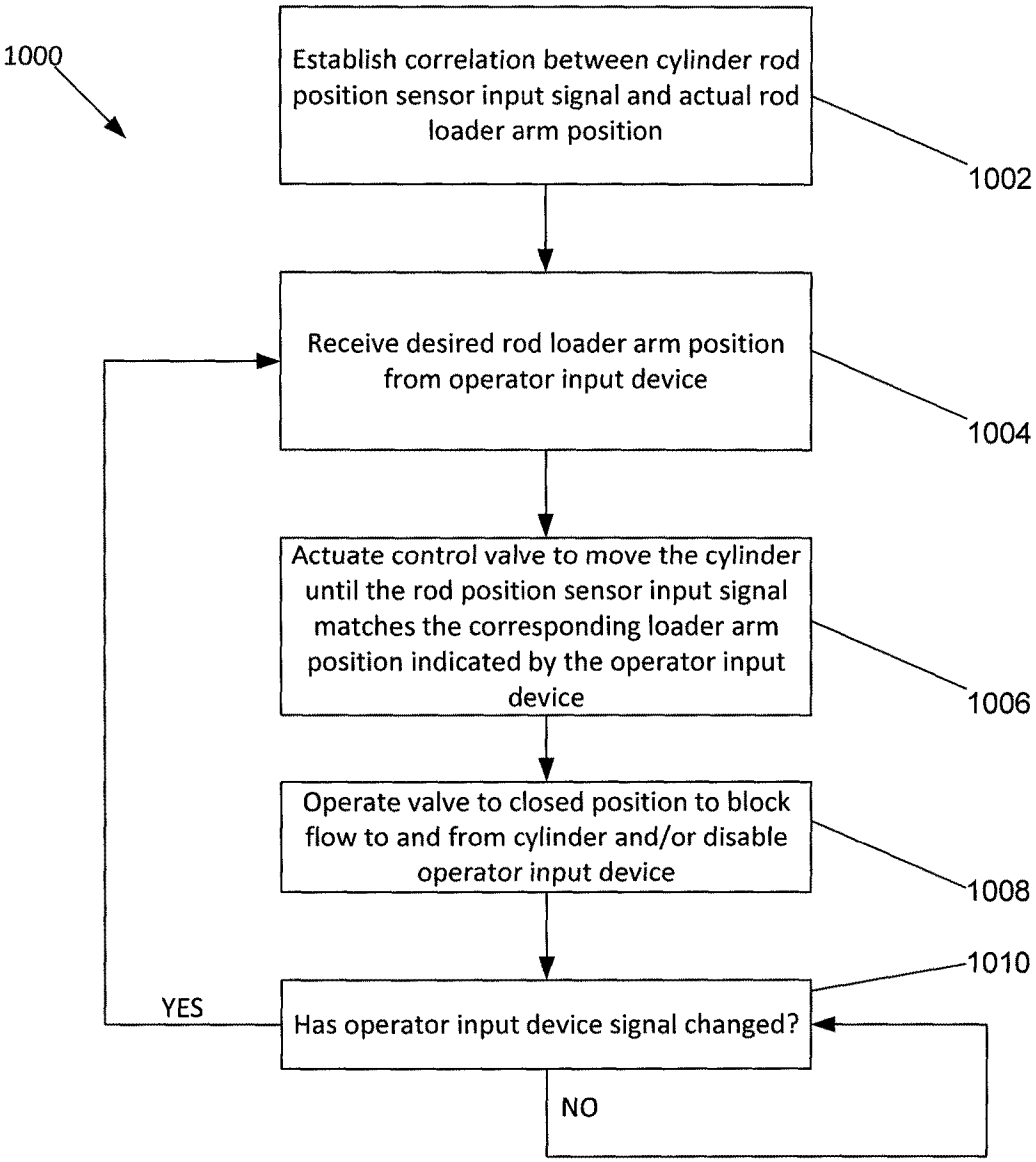
FIG. 22 is a schematic process flow diagram relating to control of the carriage assembly and directional drilling machine of FIG. 4.

Referring to FIG. 22, a method 1000 for operating the positionable carriage assembly 100 of FIGS. 4-22 is presented. As shown, the method 1000 may include a first step 1002 of establishing correlation between cylinder rod position sensor input signal and actual rod loader arm position. This step may be accomplished during original factory setup of the operation of the machine to ensure that the loader arms move to the desired location when commanded to do so. The method 1000 may also include a step 1004 of receiving a desired rod loader arm position from operator input device. In one example, the operator input device may be a dial and/or trigger. In a step 1006, one or more control valves are actuated to move the cylinder until the rod position sensor input signal matches the corresponding loader arm position indicated by the operator input device. In a step 1008, and once the arms are in the desired position, the valve is operated to a closed position to block flow to and from cylinder, and/or the operator input device is disabled which then closes the valve. In a step 1010, the status of the operator input device signal is continuously or periodically monitored for a change in status. Where a change is detected, the method 1000 can be returned back to step 1004 to execute another movement operation.

The combination of the disclosed carriage assembly 100, including mechanically linked arms 102 driven by one or more linear actuators 172, 180, and an electronic control system providing closed-loop position feedback, results in a system in which a high degree of placement, and movement controllability is provided. Such accuracy and controllability is not generally obtainable in systems using independent hydraulic or electric motors to position separate arms. This advantage is particularly useful in applications where it is desired to move an elongate object or load 10 without subjecting the load 10 to twisting, torsional, and/or bending loads during a positioning operation.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

The invention claimed is:

1. A positionable carriage assembly comprising:

a. an actuation device;

b. a linear drive element linked to the actuation device, the linear drive element including a first rack and a second rack;

c. a third rack;

d. a fourth rack;

e. a first gear structure operably intermeshing with the first rack and the third rack;

f. a second gear structure operably intermeshing with the second rack and the fourth rack; and g. at least one carriage mounted to one or both of the third and fourth racks;

wherein the actuation device includes:

i. a first linear hydraulic cylinder having a first cylinder and a first rod, the first linear hydraulic cylinder being movable between a retracted position and an extended position by a control valve; and ii. a second linear hydraulic cylinder having a second cylinder and a second rod, the second linear hydraulic cylinder being movable between a retracted position and an extended position by the control valve, the second rod being operably connected to the first rod;

iii. wherein the linear drive element is movable in a first direction when the control valve actuates the first linear hydraulic cylinder towards the extended position and actuates the second linear hydraulic cylinder towards the retracted position; and iv. wherein the linear drive element is movable in a second direction opposite the first direction when the control valve actuates the first linear hydraulic cylinder towards the retracted position and actuates the second linear hydraulic cylinder towards the extended position.

2. The positionable carriage assembly of claim 1, wherein the linear drive element is a rigid elongate member interconnecting the first and second racks, and wherein the first rack and the second rack are co-linearly arranged.

3. The positionable carriage assembly of claim 1, wherein the third and fourth racks are oriented generally perpendicular to the first and second racks.

4. The carriage assembly of claim 1, wherein:

a. the carriage includes a first carriage element mounted to the third rack and a second carriage element mounted to the fourth rack.

5. The carriage assembly of claim 4, wherein:

a. the first carriage element defines a first rod loader arm; and b. the second carriage element defines a second rod loader arm.

6. The horizontal directional drill of claim 5, wherein the first rod loader arm and the second rod loader arm are configured to be moved in unison by operation of at least one of the first or second linear hydraulic cylinder.

7. The carriage assembly of claim 4, wherein:

a. the first gear structure includes a first pinion gear intermeshing with the first rack and a second pinion gear intermeshing with the third rack;

b. the second gear structure includes a third pinion gear intermeshing with the second rack and a fourth pinion gear intermeshing with the fourth rack; and c. translation of the linear drive element along a first direction imparts a synchronized movement of the first and second carriage elements in a second direction generally orthogonal to the first direction.

8. The horizontal directional drill of claim 1, further comprising a rod loader box configured for carrying at least one drill rod, the rod loader box being carried by the at least one carriage.

9. A drilling machine comprising:

a boring mechanism for driving a string of drill rods into the ground;

a magazine including a plurality of vertical columns for storing the drill rods, wherein the magazine is configured such that the drill rods can be discharged from a bottom of the magazine bottom ends of the columns; and a rod delivery system including:

first and second carriage arms for moving drill rods along a first orientation from beneath the magazine to the boring mechanism, the first and second carriage arms each including a rod receiving location for receiving a drill rod to be delivered from the magazine to the boring mechanism, the first and second carriage arms being movable in unison with one another along the first orientation to move the drill rods from the magazine to the boring machine, the carriage arms being positionable in different rod receiving positions corresponding to the rod receiving locations being positioned beneath different ones of the vertical columns;

first and second carriage racks respectively coupled to the first and second carriage arms, wherein the first and second carriage racks move with the first and second carriage arms along the first orientation;

a drive rack structure positioned beneath the magazine;

at least one hydraulic cylinder positioned beneath the magazine for moving the drive rack structure back and forth along a second orientation that is generally orthogonal to the first orientation;

a first rotational gear structure that intermeshes with the first carriage rack and the drive rack structure such that movement of the drive rack structure along the second orientation causes movement of the first carriage rack along the first orientation; and a second rotational gear structure that intermeshes with the second carriage rack and the drive rack structure such that movement of the drive rack structure along the second orientation causes movement of the second carriage rack along the first orientation.

10. The drilling machine of claim 9, wherein the drive rack structure includes a first drive rack that intermeshes with the first rotational gear structure and a second drive rack that intermeshes with the second rotational gear structure, and wherein the drive rack structure includes an elongate member to which the first and second drive racks are coupled, wherein the at least one hydraulic cylinder drives the elongate member back and forth along the second orientation.

11. The drilling machine of claim 10, wherein the first rotational gear structure includes first and second gears that are rotationally fixed relative to each other and that rotate in unison about a first rotational axis, wherein the first gear has a larger diameter than the second gear and intermeshes with the first carriage rack, and wherein the second gear intermeshes with the drive rack structure; and wherein the second rotational gear structure includes third and fourth gears that are rotationally fixed relative to each other and that rotate in unison about a second rotational axis, wherein the third gear has a larger diameter than the fourth gear and intermeshes with the second carriage rack, and wherein the fourth gear intermeshes with the drive rack structure.

12. The drilling machine of claim 9, wherein the drive rack structure is movable along the second orientation until the rod receiving locations align with one of the plurality of vertical columns from which a drill rod is to be discharged.

13. The drilling machine of claim 9, wherein the carriage arms each have an upper blocking surface that opposes the bottom ends of the columns to prevent drill rods from unintentionally being dispensed from the magazine.

14. The drilling machine of claim 9, wherein the at least one hydraulic cylinder includes only one hydraulic cylinder.

15. The drilling machine of claim 9, wherein the at least one hydraulic cylinder includes a first hydraulic cylinder and a second hydraulic cylinder.

16. The drilling machine of claim 15, wherein the drive rack structure interconnects the first and second carriage racks, and wherein the first and second carriage racks are co-linearly arranged.

* * * * *